US005459481A

United States Patent [19]

Tanaka et al.

[11] Patent Number: 5,459,481

[45] Date of Patent: Oct. 17, 1995

[54] DRIVING METHOD FOR LIQUID CRYSTAL ELECTRO-OPTICAL DEVICE

[75] Inventors: Takaaki Tanaka; Yuzuru Sato, both of Suwa, Japan

[73] Assignee: Seiko Epson Corporation, Tokyo, Japan

[21] Appl. No.: 50,241

[22] PCT Filed: Apr. 3, 1992

[86] PCT No.: PCT/JP92/00411

§ 371 Date: Jul. 2, 1993

§ 102(e) Date: Jul. 2, 1993

[30] Foreign Application Priority Data

Sep. 5, 1990 [JP] Japan ..... 2-236454
Sep. 5, 1991 [JP] Japan ..... 3-226095

[51] Int. Cl.[6] ..... G09G 3/36

[52] U.S. Cl. ..... 345/95; 345/210

[58] Field of Search ..... 345/97, 94, 95, 345/99, 208, 209, 210; 359/56

[56] References Cited

U.S. PATENT DOCUMENTS 5,033,822 7/1991 Ooki et al. ..... 345/97

FOREIGN PATENT DOCUMENTS 25834 1/1990 Japan .
116822 5/1990 Japan .
130525 5/1990 Japan .
153322 6/1990 Japan .
173724 7/1990 Japan .
230117 9/1990 Japan .
282724 11/1990 Japan .
271326 11/1990 Japan .
125119 5/1991 Japan .
279920 12/1991 Japan .
291629 12/1991 Japan .
4249290 9/1992 Japan .
4280220 10/1992 Japan .
4371919 12/1992 Japan .

OTHER PUBLICATIONS

Electro-Optical Properties of Fluorine-Containing Ferroelectric Liquid Crystal Cells, M. Yamawaki et al., Japan Display '89, pp. 26–29.

Ferroelectric Liquid Crystal Display Using Tristable Switching, Yuichiro Yamada et al., Japanese Journal of Applied Physics, vol. 29, No. 9, Sep. 1990, pp. 1757–1764.

*Primary Examiner*—Richard Hjerpe
*Assistant Examiner*—Lun-Yi Lao
*Attorney, Agent, or Firm*—Eric B. Janofsky

[57] ABSTRACT

A time-sharing addressing method for an antiferroelectric phase liquid crystal element that demonstrates tristable switching behavior, wherein the drive voltage waveform is made an alternating current and the time average value of the voltage, including the depolarization field due to spontaneous polarization of the liquid crystal, actually applied to the liquid crystal substance in one frame or two frames is made zero for the purpose of expanding the drive voltage margin and the operating temperature margin of the element, shortening the screen scanning time and preventing degradation of the electro-optical characteristic by suppressing polarization of the electric charge due to spontaneous polarization of the liquid crystal. Also, by providing the blanking period required for relaxation from a ferroelectric phase to an antiferroelectric phase in the non-selection period, the time required for screen scanning is shortened, and by changing the length of the blanking period according to the temperature dependence of the response-relaxation time, the operating temperature margin is expanded.

11 Claims, 21 Drawing Sheets

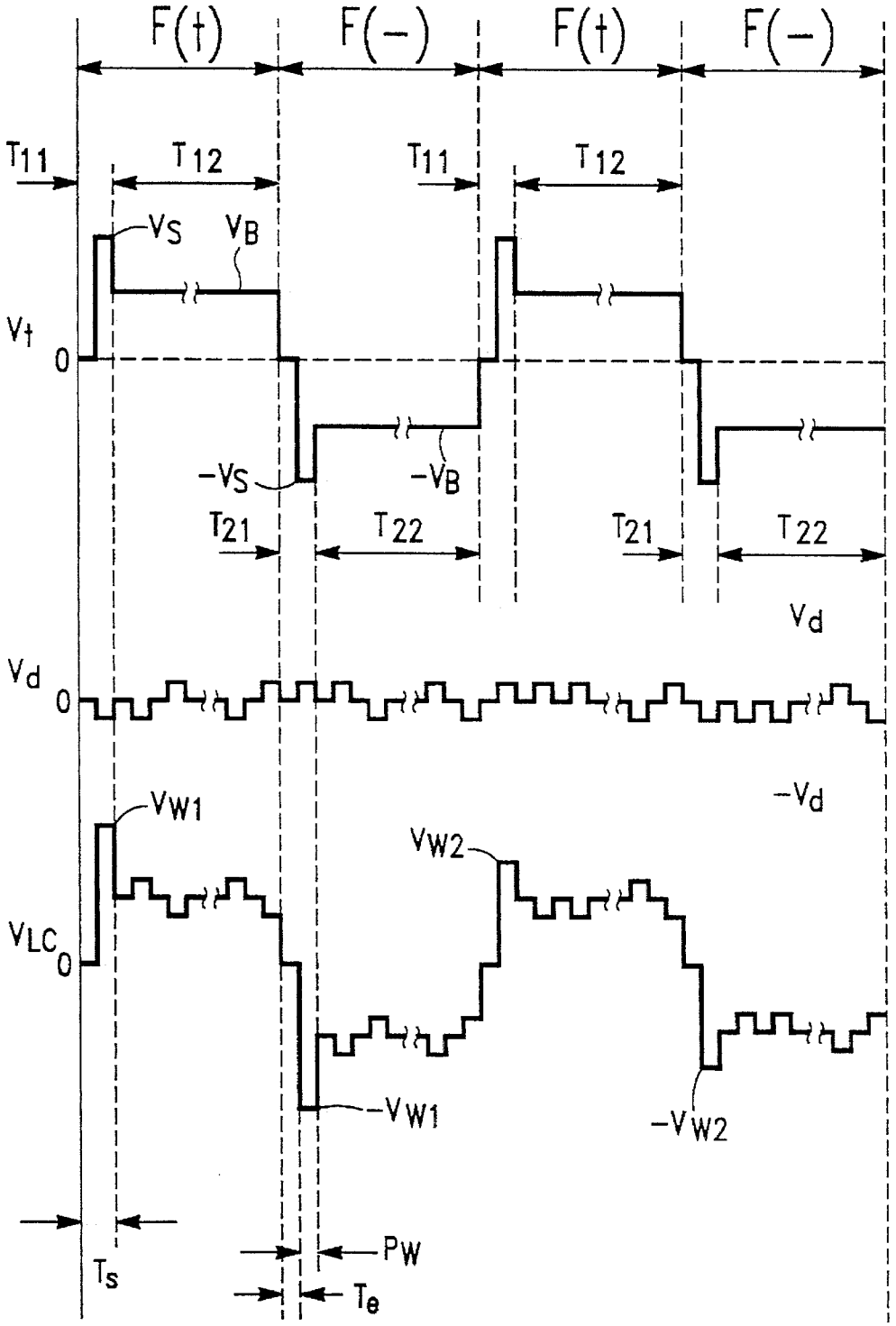
FIG.−30

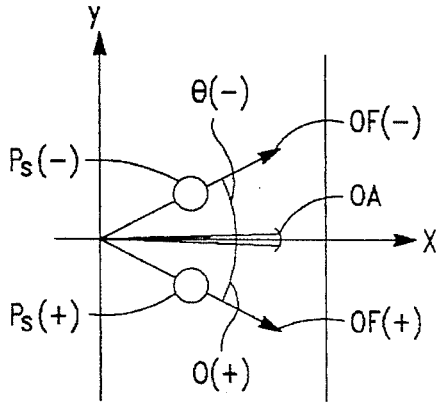
FIG.−32A
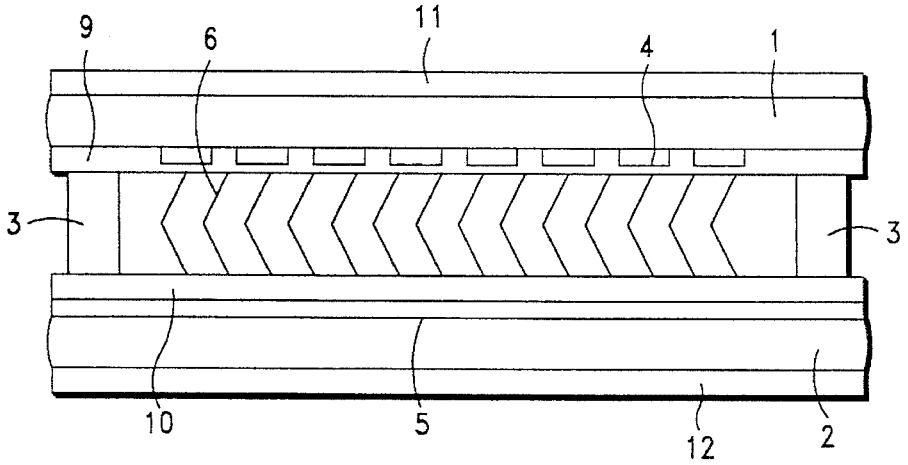
FIG.−32B
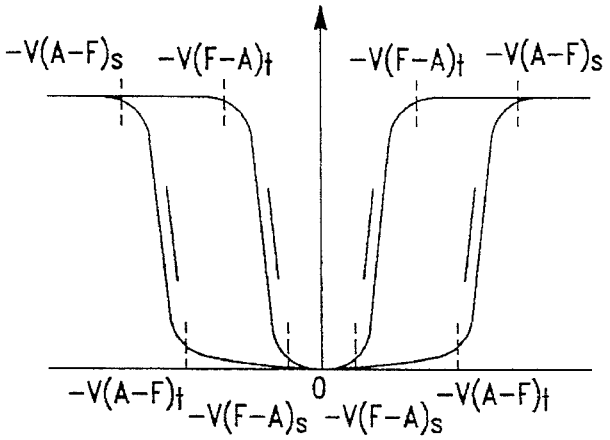
FIG.−33

DRIVING METHOD FOR LIQUID CRYSTAL ELECTRO-OPTICAL DEVICE

BACKGROUND OF THE INVENTION

1. Field of the Invention

This invention relates generally to a driving method for display elements, light valves, etc., and more particularly it relates to a driving method for display elements that use a liquid crystal substance.

2. Related Art

The tristable switching of antiferroelectric liquid crystal is expected to solve some of the problems inherent in prior art surface stabilized ferroelectric liquid crystal (SSFLC), and its research is actively going forward. (Refer to A. D. L. Chandani, et al.: Jpn. J. Appl. Pys., 27, L729 (1988) and A. D. L. Chandani, et al.: Jpn. J. Appl. Phys., 28, L1265 (1988).)

The main features of tristable switching are:

1) Antiferroelectric-ferroelectric phase transition due to voltage application has a steep threshold characteristic with respect to DC voltage (FIG. 33).
2) Antiferroelectric-ferroelectric phase transition is accompanied by a wide optical hysteresis, and the selected state can be maintained as long as a bias voltage is applied after an antiferroelectric phase or a ferroelectric phase is selected.
3) The two orientation states in an electric field-induced ferroelectric phase can be made optically equivalent.
4) Since polarization of the electric charge in the liquid crystal substance can be prevented, there is no deterioration over time of the electro-optical characteristic such as is seen in SSFLC.

By taking advantage of these characteristics, time-sharing addressing is possible in a simple matrix with no restriction on the duty ratio. Examples of previously known driving methods are noted in M. Yamawaki, et al., *Digest of Japan Display* '89, p. 26 (1989) (FIG. 30). In FIG. 30, $V_t$ and $V_d$ are the voltage waveforms supplied to the scanning electrodes and signal electrodes, respectively, and $V_{LC}$ is a composite waveform applied to the liquid crystal layer $V_{LC}=V_t-V_d$. In this driving method, frame F(+) on which a positive polarity voltage is applied and the subsequent negative polarity frame F(−) are a pair.

The principle of display by means of this driving method is explained using FIGS. 32A and 32B. Referring if FIG. 32A, optical axis OA in the antiferroelectric phase is perpendicular to the smectic layer. As shown in FIG. 32B, when a cell comprising liquid crystal 6 sandwiched between two glass substrates 1, 2 on which transparent electrodes 4, 5 and alignment films 9, 10 are formed is disposed between two polarizers 11, 12 whose polarization axes are perpendicular to each other such that optical axis OA is parallel to one of the polarization axes, the element goes to a light-blocking condition (tentatively OFF). Even if the voltage waveform in frame F'(+) or F'(−) in FIG. 30 is applied on this condition, as long as $|V_{W2}|<|V(A-F)t|$ (see FIG. 33), the light transmittance changes very little and the OFF condition can be maintained. In case of which the voltage waveform of F(+) or F(−) in FIG. 30 is applied, the liquid crystal will respond if $|V_{W1}|>|V(A-F)s|$, and change to ferroelectric phase(+) or ferroelectric phase (−). Ferroelectric phase(+) and ferroelectric phase (−), have the respective optical axes OF(+) and OF(−) and spontaneous polarizations Ps(+) and Ps(−). Since the optical axes form angle θ(+) or θ(−) with the polarization axis, a light transmission condition (tentatively ON) is set. Since angles θ(+) and θ(−) are equal, they can both be treated as being optically equivalent.

However, the prior art driving method has the two problems explained below.

One problem concerns the stability of the antiferroelectric phase. The antiferroelectric phase generally has a steep threshold characteristic with respect to DC voltage. Even if a single-polarity bias voltage is applied during the non-selection period ($T_{22}$ in the figure) after the antiferroelectric phase has been selected in the selection period ($T_{12}$ in the figure) as shown in FIGS. 31A and 31B, the state of the antiferroelectric phase can be maintained regardless of the duration in which the bias voltage is applied. However, in further research by the inventors, a phenomenon was observed in several liquid crystal materials in which the state gradually changed from the antiferroelectric phase to the ferroelectric phase as time elapsed from when the bias voltage was first applied as shown in FIG. 31C. Causes for this are considered to be the occurrence of a pretrasitional effect in the low voltage range as shown in FIG. 33, and also an increase in the amplitude of the data signal superposed on the bias voltage during the non-selection period because V(A−F)S−V(A−F)t is large when the steepness of the threshold characteristic is low. Phenomena such as these cause such problems as a lower contrast ratio as the duty ratio of the element increases.

The other problem concerns the speed of relaxation from the ferroelectric phase to the antiferroelectric phase. The speed of the relaxation is slower than the speed of response in switching in the opposite direction. In addition, a temperature dependence is observed in the speed of relaxation. By means of the prior art driving method, the scanning frequency had to be set low to match the response characteristic of the liquid crystal material used, which did not allow smooth scrolling of screen or smooth movement of a pointing devices.

The invention solves the above problems and its purpose is to offer a multiplexing drive method that takes sufficient advantage of the features of the tristable switching.

SUMMARY OF THE INVENTION

Accordingly, the driving method for a liquid crystal electro-optical element of the invention makes the drive voltage waveform an alternating current, whereby it zeros the time average value of the voltage actually applied to the liquid crystal substance in one or two frames, including the depolarization field caused by the spontaneous polarization of the liquid crystal. Also, by providing the blanking period which is necessary for the relaxation from the ferroelectric phase to the antiferroelectric phase within the non-selection period, the time required for screen scanning is shortened, and the operating temperature margin is expanded by varying the length of the blanking period according to the temperature dependence of the relaxation time.

More specifically, a driving method for a liquid crystal element comprising liquid crystal that has two states in a ferroelectric phase and one state in an antiferroelectric phase and is sandwiched between the opposing electrode surfaces of a substrate having scanning electrodes and a substrate having signal electrodes, wherein the selection period has a first period in which a voltage pulse for switching the direction of orientation of the liquid crystal molecules to one orientation is applied to the liquid crystal substance and a second period in which:

a) a voltage pulse whose absolute value is less than the threshold value if the orientation state to be selected is an antiferroelectric phase; or b) a voltage pulse whose absolute value is larger than the threshold value if the orientation state to be selected is a ferroelectric phase;

is applied to the liquid crystal substance as a voltage pulse for selecting whether or not the direction of the orientation of the liquid crystal molecules is to be changed from the orientation in the first period to another orientation and the non-selection period has a third period in which a voltage pulse group for maintaining the orientation selected in the second period during the selection period is applied to the liquid crystal layer and a fourth period in which a voltage pulse group whose absolute value is less than the threshold value and which maintains the state selected in the second period if the selected state is an antiferroelectric phase or relaxes the state selected in the second period to the antiferroelectric phase if the selected state is a ferroelectric phase is applied to the liquid crystal layer.

The voltage waveform applied to the liquid crystal layer is set so that its polarity inverts every fixed period and the sum of the products of the applied voltage and duration becomes zero.

The voltage waveform applied to the liquid crystal substance is set so that the sum of the products of the applied voltage and duration become zero in one scanning period comprising a selection period and a non-selection period.

The time ratio of the third period and the fourth period in the above non-selection period is changed according to the environmental temperature of the element.

Time-sharing addressing of a liquid crystal display element comprising liquid crystal that has two orientations in a ferroelectric phase and one orientation in an antiferroelectric phase and is sandwiched between scanning electrodes and signal electrodes disposed in a matrix, wherein the scanning electrodes are sequentially scanned every n (integer greater than zero) electrodes and one screen is formed by n+1 screen scans.

Time-sharing addressing of a liquid crystal display element in which the scanning electrodes and signal electrodes are disposed in a matrix, wherein a selection waveform is line-sequentially supplied only to the scanning electrodes in the area where it has become necessary to rewrite the displayed information and a voltage pulse group for maintaining the orientation of the liquid crystal molecules is supplied to the pixels positioned on the other scanning electrodes.

Other objects, advantages and attainments together with a fuller understanding of the invention will become apparent and appreciated by referring to the following description and claims taken in conjunction with the accompanying drawings.

BRIEF DESCRIPTION OF THE DRAWINGS

FIG. 30 shows prior art drive voltage waveforms.

FIGS. 32A and 32B are generalized diagram of the element used in the embodiments of the invention.

FIG. 33 is a diagram for explaining the electro-optical characteristic of the element used in the embodiments of the invention.

DETAILED DESCRIPTION OF THE INVENTION

The invention is explained in detail below using specific embodiments. The sample used was fabricated by forming a polyimide orientation film on transparent electrodes and the orientation film was rubbed in one direction and injecting the liquid crystal material 4-(1-methylheptyloxycarbonyl)phenyl 4'-octyloxybiphenyl-4-carboxylate (MHPOBC) in a cell with a 1.7-un gap by heating, and the environmental temperature was maintained in the temperature range of the antiferroelectric chiral smectic C phase ($S_{CA}$±phase). The structure of the element is shown in FIG. 32(*b*).

First Embodiment

Figure 1:
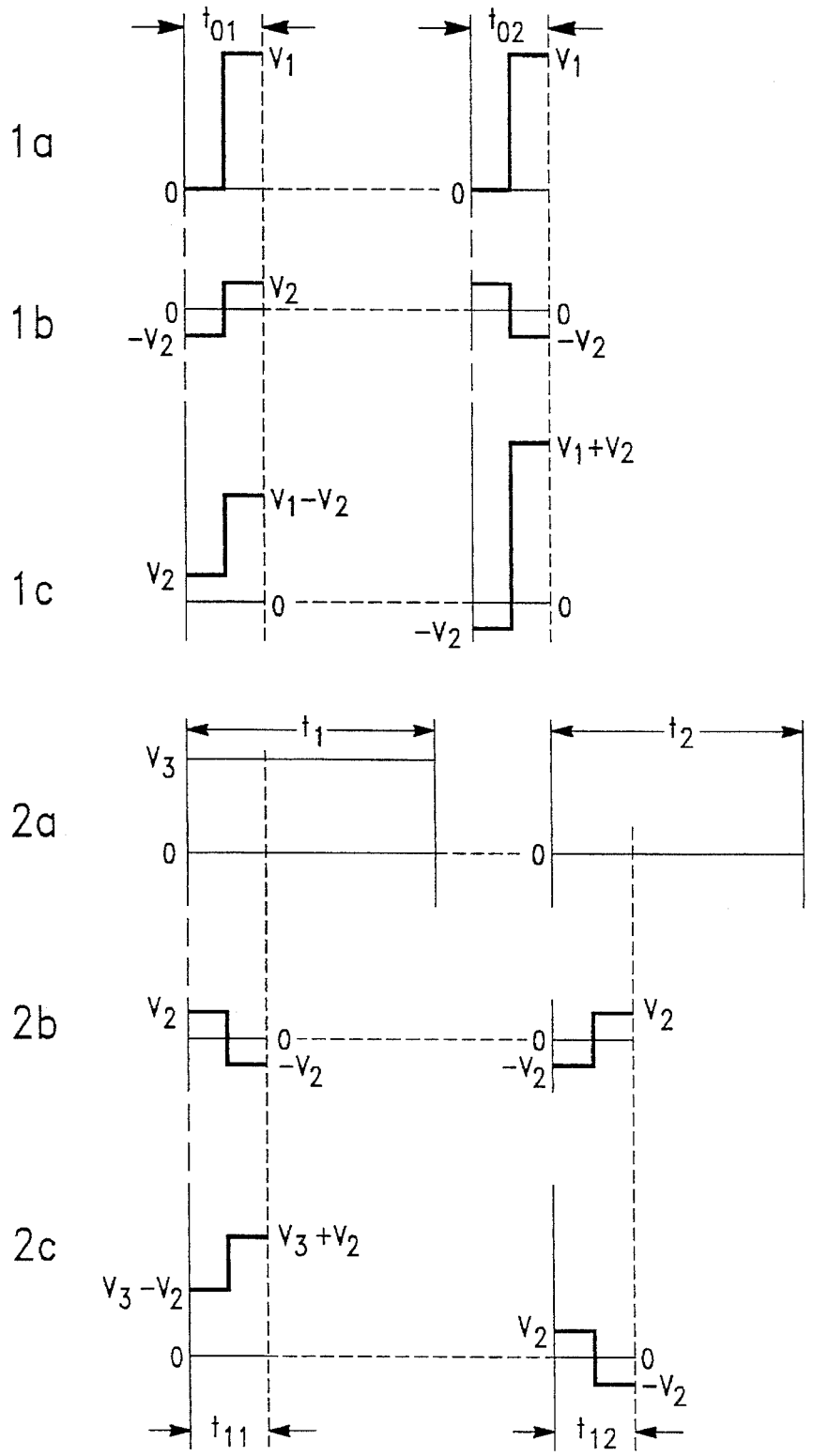
FIG. 1 shows drive voltage waveforms of a first embodiment of the invention.
Figure 2:
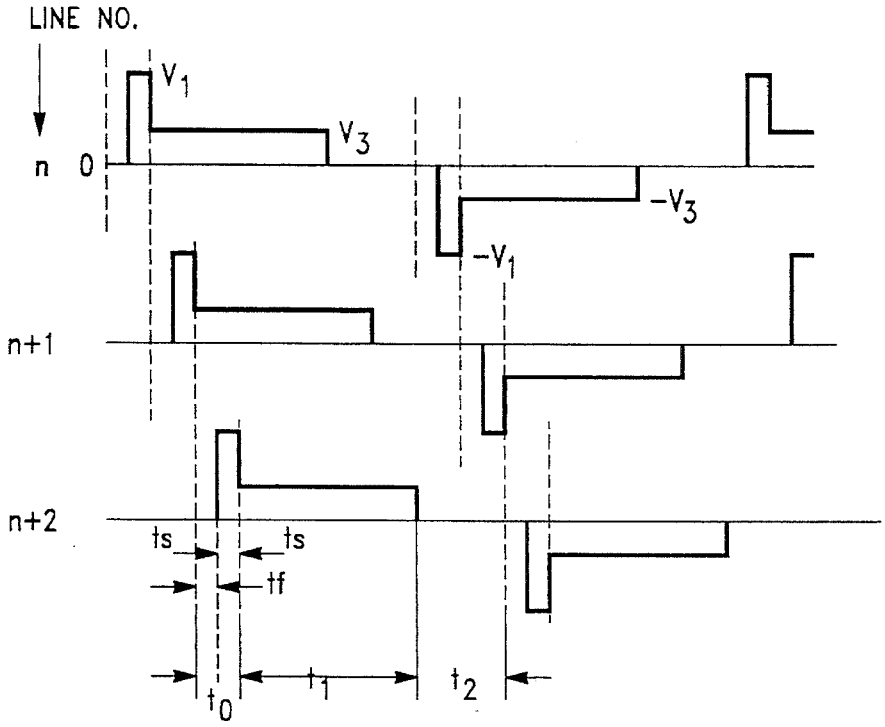
FIG. 2 shows the timing of voltage waveforms applied to adjacent selected scanning electrodes in the drive waveforms of the first embodiment.

The drive voltage waveforms of the first embodiment of the invention are shown in FIG. 1, where 1*a* and 2*a* are scanning electrode waveforms, 1*b* and 2*b* are signal electrode waveforms, and 1*c* and 2*c* are composite waveforms of these. Also, $t_{01}$ and $t_{02}$ correspond to the selection period and $t_1$ and $t_2$ correspond to the non-selection period, and the voltage waveforms 1*c* and 2*c* are applied to the liquid crystal element in the order $t_{01}$ or $t_{02}$, $t_1$ and $t_2$. The voltage waveforms are supplied to the scanning electrodes according to timing such as that shown in FIG. 2. When the element was maintained at a temperature of 90° C. and driven under the conditions pulse width=80 μs, $V_1$=18 V, $V_2$=2.7 V and $V_3$=5 V, a contrast ratio of 1:18 was obtained. As shown in FIG. 2, selection period $t_0$ comprises two periods $t_f$ and $t_s$, and non-selection period comprises two periods $t_1$ and $t_2$.

When the same element was driven using similar voltage settings, the temperature of the element was varied from 70° to 100° C., and the blanking period ($t_2$ in FIG. 2) in the non-selection period was set to 250 us at 70° C. and 170 μs at 100° C. and continuously varied over that interval, an optical characteristic similar to that obtained above could be maintained within the temperature range.

Next, the display speeds by the drive method of the invention and a prior art drive method are compared. Since the relaxation time from a ferroelectric phase to an antiferroelectric phase is approximately 420 us, the length of the selection period in the prior art method is 80×2+420= 580 us. In the method of the invention, however, the length of the selection period (write period) is 160 us. Therefore, by using the drive method of the invention, a speed about 3.5 times faster than the drive method of the prior art can be achieved. However, the effect of the invention on the speed depends on the relaxation time from a ferroelectric phase to an antiferroelectric phase, and the longer the relaxation time, the larger the effect.

Second Embodiment

Figure 3:
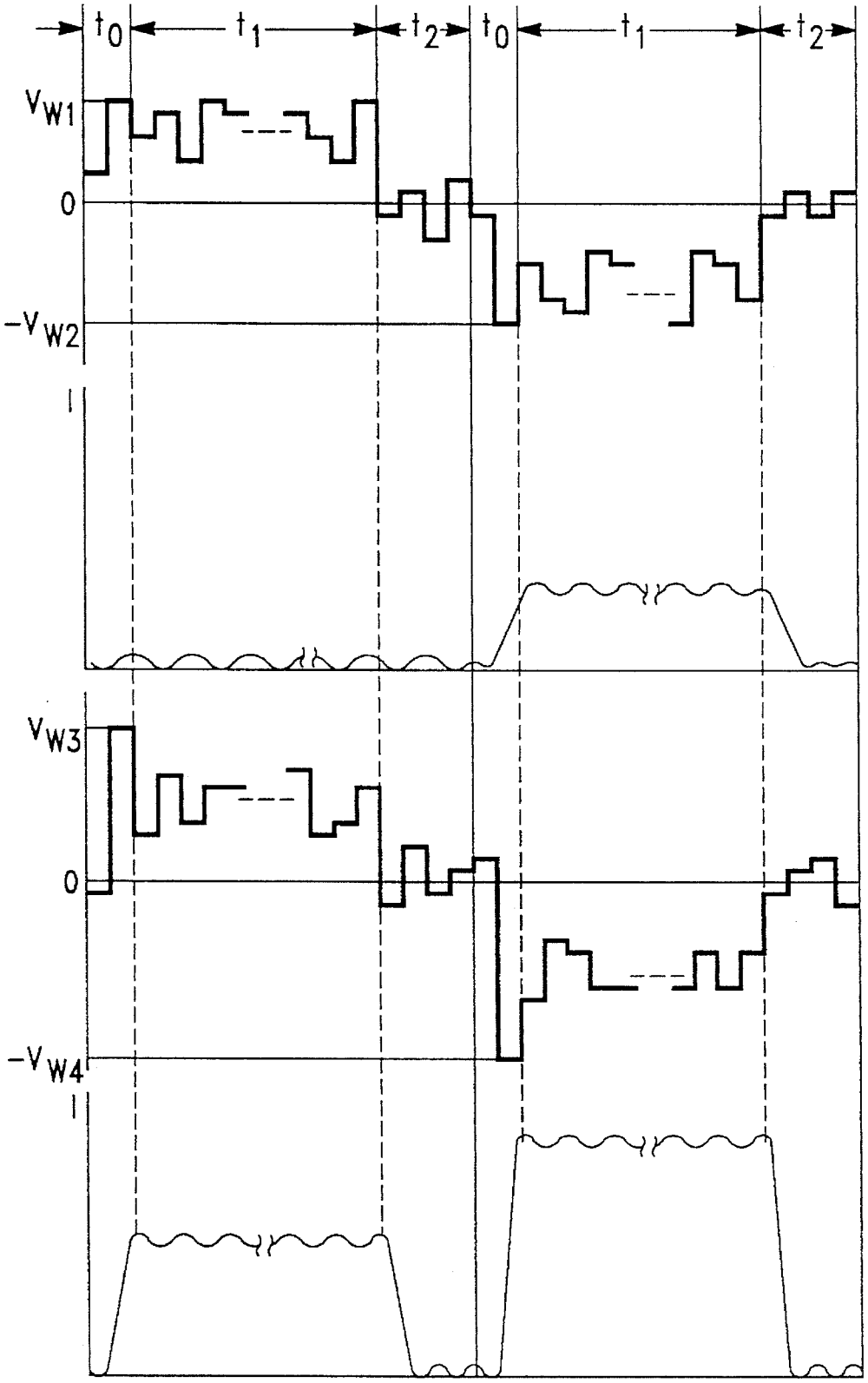
FIG. 3 shows drive voltage waveforms of a second embodiment of the invention.

FIG. 3 shows the composite waveform and optical response of the element when gray scale display is performed by modulating the voltage of the signal electrode waveform in the drive method of the same configuration as in the first embodiment. A voltage waveform having four peak value levels ($V_{w1}$, $-V_{w2}$, $V_{w3}$, $-V_{w4}$) as the write pulse in the composite waveform was composed by applying two levels and two polarities to the signal waveform synchronized with the selection period $t_0$. When the waveform was applied to the liquid crystal, an optical response such as that seen in FIG. 3 was obtained. The peak value $V_w$ of the write pulse to obtain an intermediate gradient can be set so that $|V(A-F)t| \leqq |V_W| \leqq |V(A-F)s|$ according to the notation in FIG. 33. Microscopic observation showed that the orientation of the liquid crystal when an intermediate gradient was selected was a multi-domain in which an antiferroelectric phase and a ferroelectric phase existed together in a suitable ratio. Since the bias voltage applied during the non-selection period acts only on the domain which has changed to a ferroelectric phase, the pixel can maintain the intermediate gradient.

Third Embodiment

Figure 4:
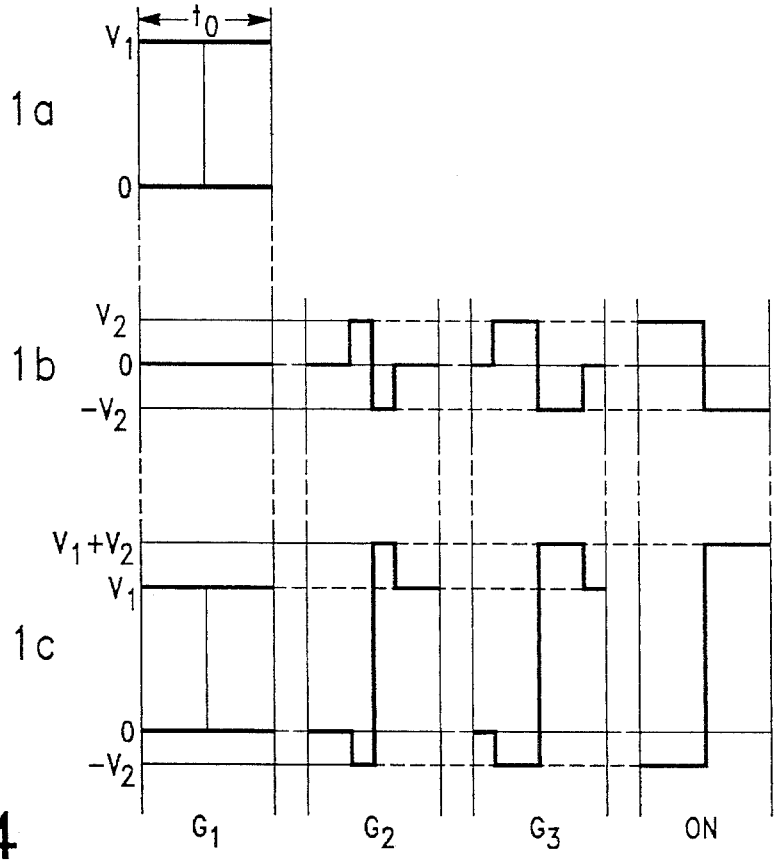
FIG. 4 shows drive voltage waveforms of a third embodiment of the invention.

Gray scale display is also possible by the same principle as described in the second embodiment by modulating the pulse width of the signal electrode waveform in drive waveforms similar to those in the first embodiment. FIG. 4 shows the voltage waveform in the selection period of the drive method used in this embodiment, where 1*a* is the scanning electrode waveform, 1*b* is the signal electrode waveform and 1*c* is the composite waveform. Using the same voltage settings as in the first embodiment, about the same display characteristic as in the second embodiment was obtained. Also, though the polarities of the signal electrode waveform are consolidated in the notation in FIG. 4, the expression of more levels of gray can be realized by also using a waveform of reverse polarity.

Fourth Embodiment

Figure 5:
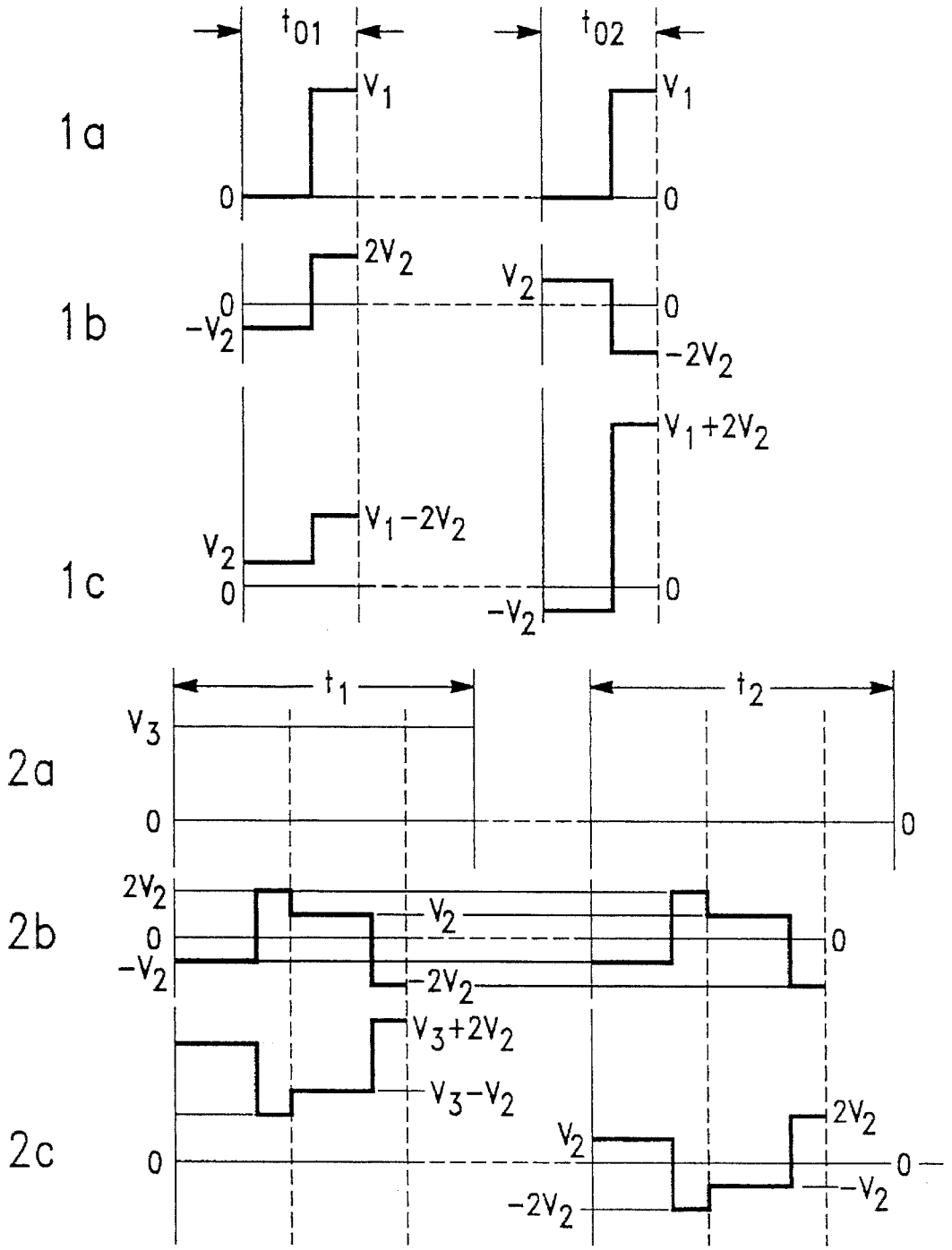
FIG. 5 shows drive voltage waveforms of a fourth embodiment of the invention.
Figure 6:
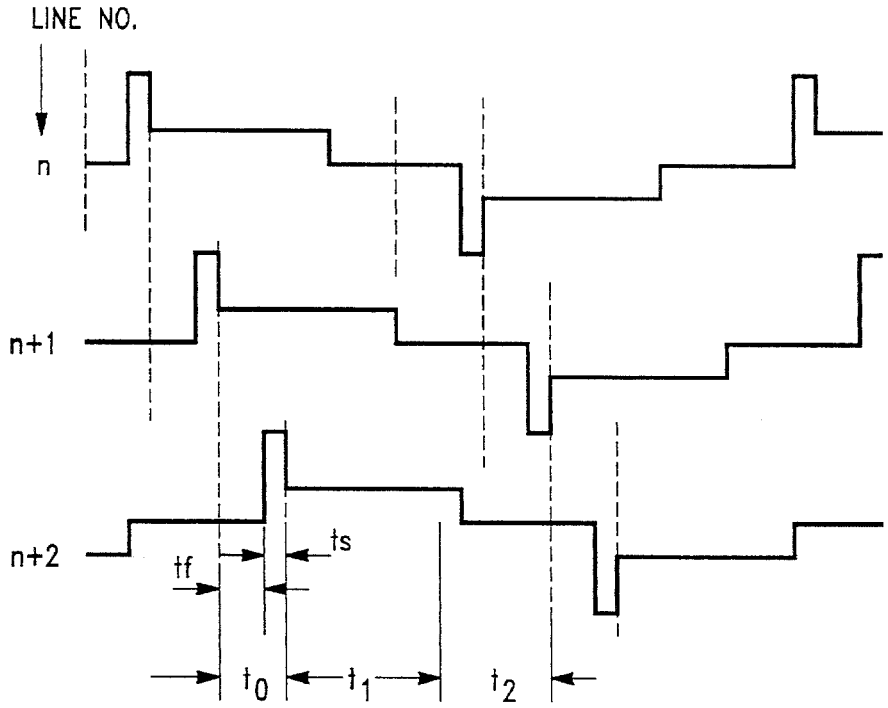
FIG. 6 shows the timing of voltage waveforms applied to adjacent selected scanning electrodes in the drive waveforms of the fourth embodiment of the invention.

Referring to FIG. 5, 1*a* and 2*a* are scanning electrode waveforms, 1*b* and 2*b* are signal electrode waveforms, and 1*c* and 2*c* are composite waveforms of these. Also, $t_{01}$ and $t_{02}$ correspond to the selection period and $t_1$ and $t_2$ correspond to the non-selection period, and voltage waveforms 1*c*, 2*c* are applied to the liquid crystal element in the order $t_{01}$ or $t_{02}$, $t_1$ and $t_2$. The voltage waveforms are supplied to the scanning electrodes according to timing such as that shown in FIG. 6. The selection period $t_{01}$ comprises two periods $t_f$ and $t_s$, and non-selection period comprises two periods $t_1$ and $t_2$. By using a signal waveform having two absolute voltage values ($|-V_2|$, $|2V_2|$) whose pulse width differ as shown in 1*b* of FIG. 5, the voltage difference between the write pulses during ON selection and OFF selection can be made larger than in the first embodiment while the waveforms are n-jade alternating current, which is effective when driving liquid crystal material whose threshold characteristic is not steep. Also, when applied to a material with a steep threshold characteristic, the voltage of the signal waveform can be set low, which makes it possible to suppress fluctuations in the optical response during the non-selection period. A contrast ratio of 1:19 was obtained when the temperature of the element was maintained at 90° C. and it was driven under the conditions pulse duration=80 μs, $V_1$=18 V, $V_2$=1.5 V and $V_3$= 5V.

When the same element was driven using similar voltage settings, the temperature of the element was varied from 70° to 100° C., and the blanking period ($t_2$ in figure) in the non-selection period was set to 250 us at 70° C. and 170 μs at 100° C. and continuously varied over that interval, an optical characteristic similar to that obtained above could be maintained within the temperature range.

Fifth Embodiment

Figure 7A:
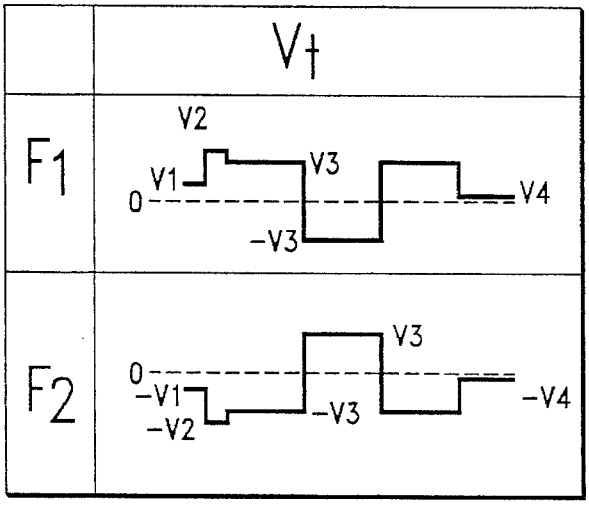
FIGS. 7A and 7B show drive voltage waveforms of a fifth embodiment of the invention.
Figure 7B:
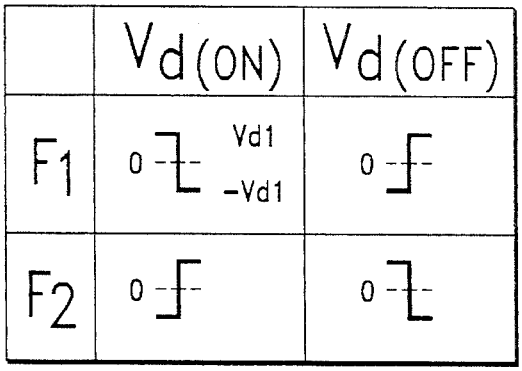
Figure 8:
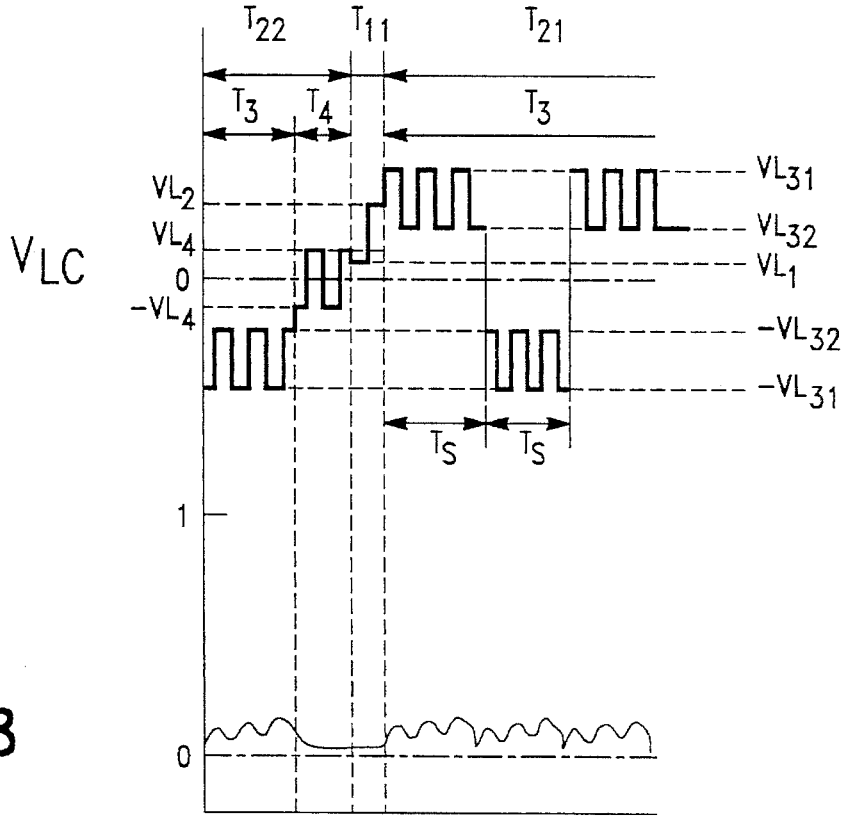
FIG. 8 shows the voltage waveform applied to the liquid crystal layer when an antiferroelectric phase condition is selected by the drive method of the fifth embodiment and the change in light transmittance with respect to said voltage waveform.

Referring to FIGS. 7A and 7B, Vt is the scanning voltage waveform and Vd(ON) and Vd(OFF) are the signal voltage waveforms for selecting a ferroelectric phase and an antiferroelectric phase, respectively. The composite waveform and optical response of the liquid crystal element are shown in FIG. 8. $T_{11}$ and $T_{12}$ (not shown in figure) are the respective selection periods for frame 1 and frame 2, and $T_{21}$ and $T_{22}$ are non-selection periods. Whether the ferroelectric phase or the antiferroelectric phase is selected, two continuous frames are a pair and scanning voltage waveforms $F_1$ and $F_2$ in FIGS. 7A and 7B are applied in frame 1 and frame 2, respectively. Therefore, the sum of the products of the applied voltage and duration in the two continuous frames is zero.

Figure 9:
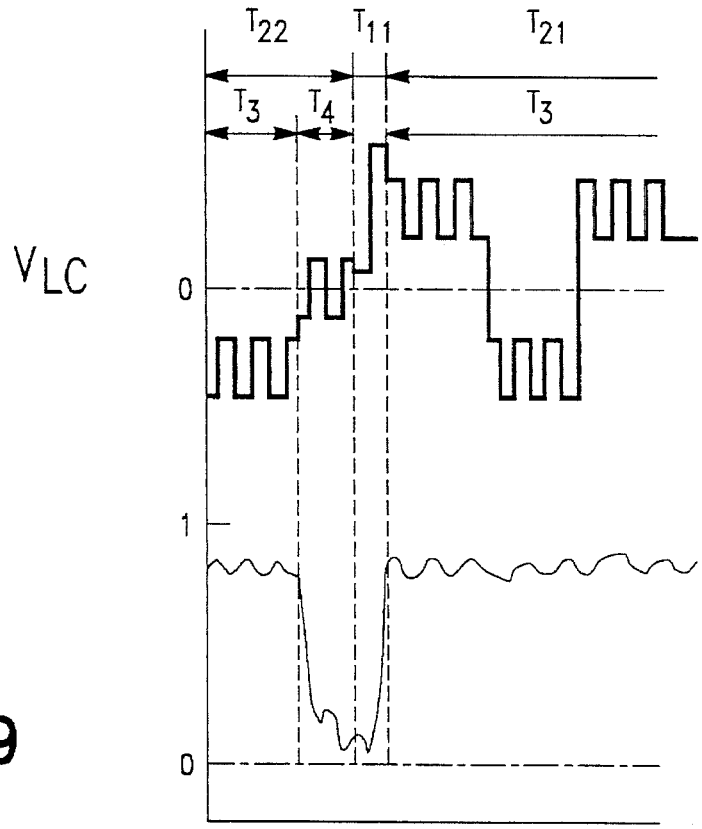
FIG. 9 shows the voltage waveform applied to the liquid crystal layer when a state of ferroelectric phase is selected by the drive method of the fifth embodiment of the invention and the change in light transmittance with respect to said voltage waveform.

Referring to FIGS. 8–9, $VL_C$ is the voltage waveform (composite waveform of scanning voltage waveform and signal voltage waveform) applied to the liquid crystal substance when an antiferroelectric phase is selected. Since the light is blocked in the antiferroelectric phase, the element goes to an OFF condition. In the fourth period T4 in the non-selection period, the blanking voltage pulse group $\pm VL_4(\pm VL_4=V_4-Vd,\ |VL_4|\leqq V(F-A)s)$ is applied. If the previously selected state is the antiferroelectric phase, the state is maintained. If the previously selected state is the ferroelectric phase, the state relaxes to the antiferroelectric phase. Further, reset is performed through the fourth and first periods by applying the first voltage pulse $VL_1$ ($VL_1=V_1-V_d$, $|VL_1|\leqq V(A-F)t$) in the first period of the selection period (first half of selection period). Next, the voltage pulse $VL_2$ ($VL_2=V_2-Vd$, $|VL_2|\leqq V(A-F)t$) for selecting an antiferroelectric phase is applied in the second period of the selection period (last half of selection period). Also, the maintenance voltage pulse group $VL_{31}$ to $VL_{32}$ ($|VL_{31}|=|V_3+Vd_1|$, $|VL_{32}|=|V_3-Vd_1|$, $|VL_{31}|\leqq V(A-F)t$, $|VL_{32}|\geqq V(F-A)t$) for maintaining the phase selected in the second period is applied in the third period T3 of the non-selection period. The maintenance voltage pulse group comprises positive polarity and negative polarity pulse groups as shown in the figure.

Figures 31A, 31B, 31C:
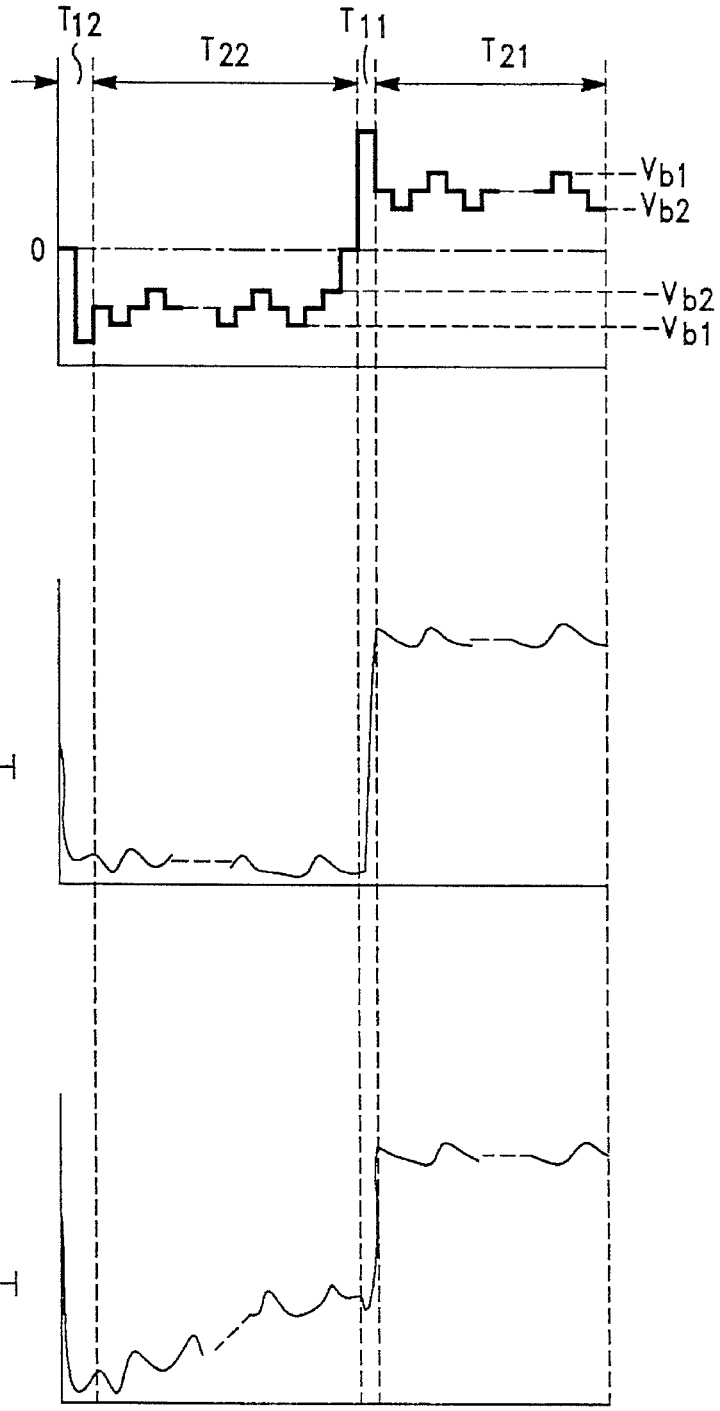
FIGS. 31A–31C show a voltage waveform impressed on a liquid crystal substance when a state of ferroelectric phase is selected by a prior art driving method and the change in the light transmittance with respect to said voltage waveform.

The change in light transmittance with respect to this voltage waveform is as shown in FIG. 8. Each time the polarity of the maintenance voltage pulse group applied in the third period inverts, the light transmittance returns to near zero, and therefore compared to the prior art example in FIG. 31(*c*), the antiferroelectric phase condition is maintained through the non-selection period, and the time average of light transmittance in the OFF condition is kept extremely low.

The voltage waveform shown in FIG. 9 is applied to the liquid crystal substance to select the ferroelectric phase. The change in light transmittance is also shown in FIG. 9. A ferroelectric phase condition is a condition that passes light. The ferroelectric phase can be selected by applying the voltage pulse $VL_2$, where $|VL_2|\geqq V(A-F)s$, in the second period.

The response of the liquid crystal molecules when the polarity of the bias voltage inverts when a ferroelectric phase (+) is maintained by positive polarity bias voltages $VL_{31}$ to $VL_{32}$ is discussed below. According to the hysteresis characteristic in FIG. 33, the condition is thought to change to an antiferroelectric phase as shown by arrow 1. However, this hysteresis characteristic is for a triangular wave voltage of sufficiently low frequency, and the state is known to switch directly to the other ferroelectric phase (–) without passing through an antiferroelectric phase in response to a pulsed voltage. Further, the inventors discovered that even if the absolute value was greater than V(F–A)t and less than V(A–F)s, the state switched directly from ferroelectric phase (+) to ferroelectric phase (–). By utilizing this characteristic, the ferroelectric phase (ON condition) can continue to be maintained even though the polarity of the bias voltage for maintaining the ferroelectric phase inverts part way through the frame. Therefore, the light transmittance in the OFF condition can be suppressed and the contrast ratio improved without lowering the light transmittance in the ON condition.

More specifically, a contrast ratio of 1:25 was obtained when the element was maintained at an environmental temperature of 70° C. and was driven by 1/400-duty multiplexing drive under the conditions pulse width Pw =80 μs, Ts=10×Pw, $T_4$=4×Pw, $V_1$=0 V, $V_2$=18 V, $V_3$=5 V, $V_4$=0 V and $Vd_1$=2.7 V. We also raised the duty ratio to 1/1000 but observed no change in the contrast ratio.

Using the same sample and same voltage settings as above, we set the environmental temperature to 100° C. We obtained a contrast ratio of 1:23 when the element was driven by 1/1000-duty multiplexing drive under the conditions Pw=80 μs, Ts=10×Pw and $T_4$=2×Pw.

Sixth Embodiment

Figure 10:
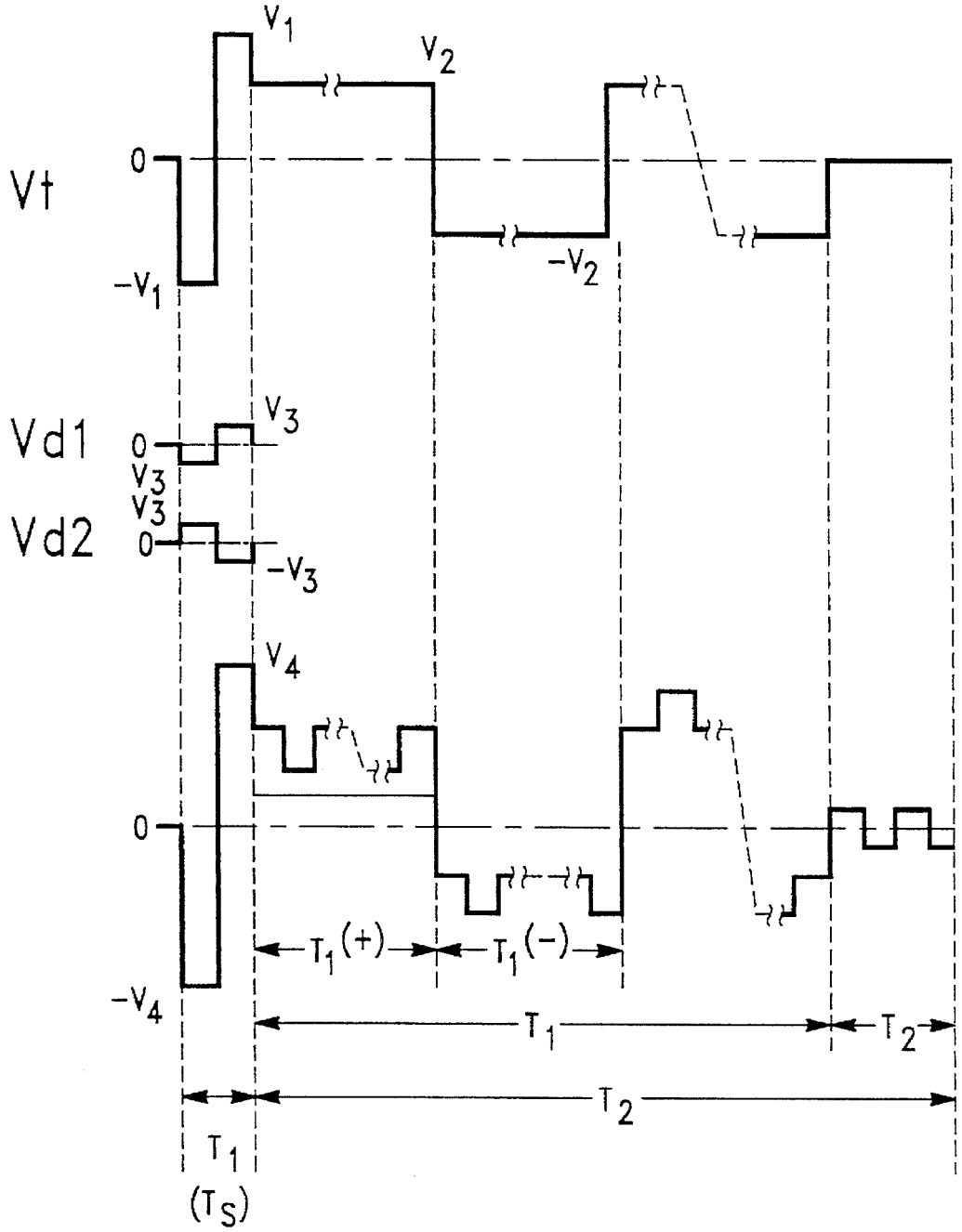
FIG. 10 shows drive voltage waveforms in a sixth and seventh embodiment of the invention.

Referring to FIG. 10, $V_t$ is the scanning voltage waveform, $Vd_1$ and $Vd_2$ are the signal voltage waveforms for selecting an antiferroelectric phase (OFF condition) and ferroelectric phase (ON condition), respectively, and VLC is the voltage waveform ($Vt-Vd_2$) applied to the liquid crystal layer when a ferroelectric phase is selected. The signal voltage waveform is an AC voltage having peak value $\pm V_3$, and the time average value within a unit time period is 0. An AC voltage having peak value $\pm V_4(=V_1\pm V_3)$ is applied to the liquid crystal layer in the selection period, and $V_1$ and $V_3$ are set so that $|V_4|>|V(A-F)t|$ when an ON condition is selected and $|V_4|,\ \leqq|V(A-F)t|$ when an OFF condition is selected. The bias voltage $|V_2|$ applied during the non-selection period is set to a value nearly intermediate between |V(A–Ft| and |V(F–A)t|. Actually, since this is simple matrix drive, the signal voltage is superposed on the bias voltage as can be seen in the waveform of VLC. The length of the second period t2 in the non-selection period depends on the temperature. Because t2 should be set to be longer than the time required for the transition from a ferroelectric phase to an antiferroelectric phase in a condition in which an AC voltage of a certain peak value ($-V_3$ here) for blanking is applied. By this means, the condition of the pixel can be reset to an antiferroelectric phase in the second period. Also, the remaining first period t1 is divided up into an even number of units and the polarity of the bias voltage is alternately inverted. The response of the liquid crystal to the AC bias voltage is the same as described in the fifth embodiment. In this manner, the time average value of the externally applied voltage becomes zero in one frame. Further, since the period in which ferroelectric phase (+) is selected by applying the positive polarity voltage and the period in which ferroelectric phase (–) is selected by applying the negative polarity voltage are equal to each other within the period in which a ferroelectric phase having a spontaneous polarization is selected, the time average value of the depolarization electric field can be made zero. That is, the ratio of t2 to t1 is dependent on the temperature.

Therefore, since this driving method prevents polarization of the electric charge, there is no degradation of the electro-optical effect, and since there is no need to use a two-frame selection method as in the prior art, the time required to display one screen of information is one half that in the prior art, thus achieving about the same speed as SSFLC.

More specifically, by maintaining the environmental temperature of the element at 70° C. and driving it with 1/400-duty multiplexing drive under the conditions pulse width Pw=80 μs, selection period ts=2×Pw, t1(+)= t1(−)= 66×ts, t2=3×ts, $V_1$=18 V, $V_2$=5 V and $V_3$=2.7 V, a contrast ratio of 1:25 was obtained. Also, the time required to display one screen of information was ts×400=64 ms.

We investigated the change in display quality with time using a reliability test in which we maintained all pixels in a ferroelectric phase (ON condition) for four weeks. We displayed some screen of information, using the same drive condition before and after the reliability test, and examined the quality of the screens. The results showed no significant difference in display quality before and after the test.

Seventh Embodiment

This embodiment uses the same sample and voltage settings as the sixth embodiment but sets the environmental temperature to 100° C. When the element was driven by 1/1000-duty multiplex drive under the conditions pulse duration Pw=80 μs, selection period ts=2×Pw, t1(+)= t1(−)=499× ts and t2=ts, a contrast ratio of 1:23 was obtained. In this case, as well, the reliability test showed no degradation of display quality.

Eighth Embodiment

Figure 11A:
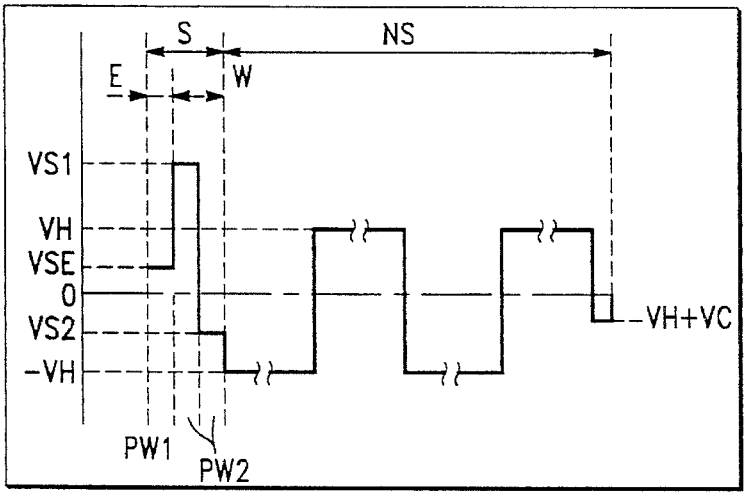
FIGS. 11A and 11B show drive voltage waveforms in an eighth embodiment of the invention.
Figure 11B:
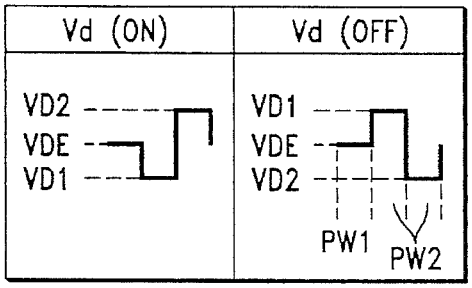
Figure 12:
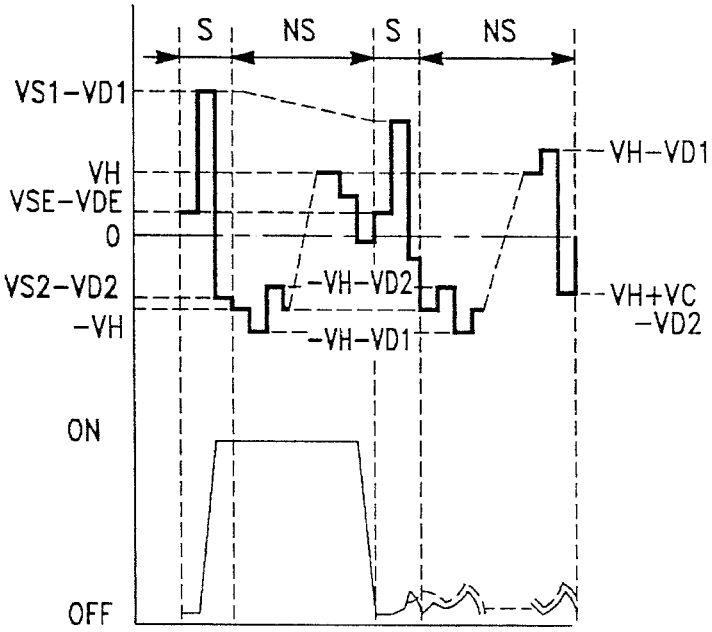
FIG. 12 shows the voltage waveform applied to the liquid crystal layer and the electro-optical response of the liquid crystal in the eighth embodiment of the invention.

Referring to FIGS. 11A and 11B, the scanning voltage waveform is shown, and Vd(OFF) and Vd(ON) are the data voltage waveforms for selecting an antiferroelectric phase (OFF condition) and ferroelectric phase (ON condition), respectively. The top part of FIG. 12 is the voltage waveform applied to the liquid crystal layer. The waveform is composed of the scanning voltage waveform and the data voltage waveform. The lower part of FIG. 12 is the electro-optical response of the liquid crystal to the voltage waveform. The blanking voltage is VSE=VDE=0[V] and the data voltage is AC voltage VD1=−VD2, |VD1|=|VD2|=3[V], the peak value of the second voltage pulse after the end of the selection period is VS1=15[V], and the peak value of the last voltage pulse is VS2=−4[V]. A±8 [V] alternating current starting with a negative polarity was used as the maintenance voltage waveform. A voltage pulse with a pulse width of PW2 and peak value of VC=−(VS1+VS2+VSE)=−11[V] was used as the compensation voltage waveform. The drive duty ratio was 1/1000, the pulse width PW1 and PW2 were 200 μs and 700 μs, and the frequency of the maintenance voltage waveform was $1/(11.1\times10^{-3})$ Hz.

When an ON data voltage waveform Vd(ON) is applied to the signal electrodes, the second voltage after the end of the selection period becomes VS1−VD1=18 [V], and therefore a phase transition from an antiferroelectric phase to a ferroelectric phase (+) occurs. The last voltage following that is −7 [V]. When the peak value of the pulse voltage changes directly from +18 [V] to −7 [V] in this manner, the condition passes the antiferroelectric phase and switches to the other ferroelectric phase (−) because 7 [V] is greater than V(F−A). Following this, the maintenance voltage pulses from −5 through −8 to −11[V] and from 5 through 8 to 11[V] are alternately applied in the non-selection period, resulting in alternating ferroelectric phase (−) and ferroelectric phase (+) conditions, and so the ON condition is maintained.

Figure 13:
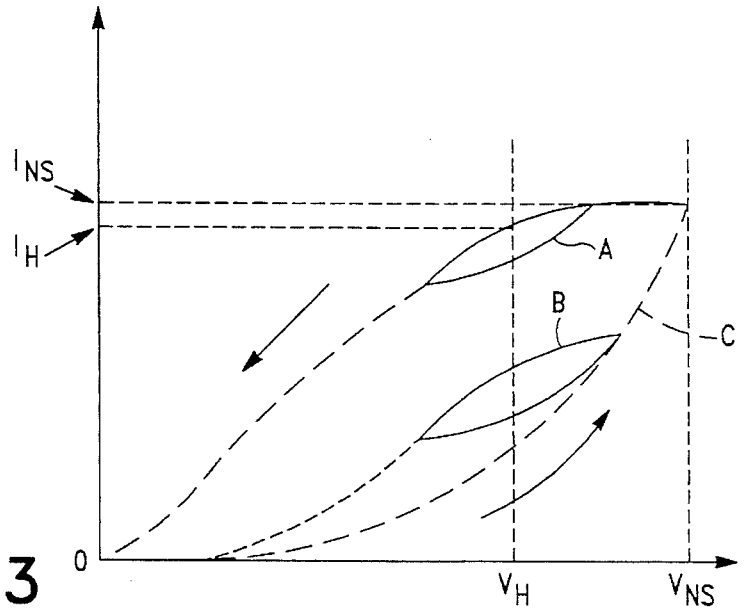
FIG. 13 shows the hysteresis characteristic in a low voltage range.

When the OFF data voltage waveform Vd(OFF) is applied to the signal electrodes, the second voltage after the end of the selection period becomes +12 [V], and since this is less than V(A−F), there is no phase transition from an antiferroelectric phase to a ferroelectric phase (+). The light transmittance at this time is INS as shown in FIG. 13. The last voltage following this is −1 [V]. Since this voltage has a polarity opposite that of the second voltage from the last, the light transmittance during this period drops to nearly zero. Following this, the maintenance voltage pulses −5−8−11[V] and 5−8−11 [V]are alternately applied in the non-selection period. In this case, the light transmittance changes so it nearly follows the loop B shown in FIG. 13. However, only the positive polarity side is shown in this figure.

The change with time in the actual light transmittance by this kind of drive method is indicated by the solid line in FIG. 12. For the sake of comparison, the light transmittance in the case of drive by a prior art method is indicated in the same figure by a dashed line. Since the maintenance voltage pulse is applied immediately after the light transmittance becomes INS upon selection in the prior art method, the light transmittance changes according to loop A in FIG. 13. By this means, though no difference in light transmittance is observed between the two in the ON condition, there is a clear difference in light transmittance in the OFF condition. The average light transmittance in the OFF condition in this embodiment is about two thirds of that by the prior art method. Since the contrast ratio is inversely proportional to the light transmittance in the OFF condition, the contrast ratio is nearly 1.5 times that in the prior art being improved from 1:11.5 to 1:17.

Further, as shown in FIG. 11A, one −3-[V] voltage pulse is applied instead of an 8-[V]maintenance voltage immediately before the blanking period (last of non-selection period). This is generated by superposing the compensation voltage pulse on that part of the maintenance voltage waveform. Therefore, the time average value of the voltage applied on the liquid crystal layer within one frame is zero and there is no polarization of the electric charge in the liquid crystal layer. The voltage applied immediately before the blanking period was made −3 [V] because an alternating maintenance voltage that starts with a negative polarization is used in this embodiment, but if an alternating maintenance voltage that starts with a positive polarity is used, that voltage becomes −19[V].

Ninth Embodiment

In this embodiment, VS2=−4[V] and VSE=4[V] are used in the drive method of the eighth embodiment. Since VC=−15[V] in this case, the voltage supplied to the scanning electrodes at end of the non-selection period becomes −7[V]. Therefore, the voltage applied to the liquid crystal layer becomes −4[V] or −10 [V]. If −10 [V] is applied when the ON condition is selected, the condition changes to ferroelectric phase (−), and therefore by applying a suitable positive polarity voltage in order to then reset to the OFF condition, reset can be performed faster than by resetting with 0 [V]. This solves the problem of the above-mentioned slow relaxation time from a ferroelectric phase to an antiferroelectric phase and shows its effectiveness when the state selected in the previous frame is a ferroelectric phase, thus facilitating high speed scanning. Therefore, drive is possible even though PW1=100 μs. The frequency of the maintenance voltage waveform is the same as in the eighth embodiment. Since PW1=200 μs in the eighth embodiment, high speed display can be realized by setting the voltage in this manner. The display characteristic is the same as in the eighth embodiment and a contrast ratio of 1:17 was obtained.

Tenth Embodiment

In this embodiment, VS2=−3 [V] was used in the drive method of the eighth embodiment. In this case, VC=−12 [V]. Other settings are the same as in the eighth embodiment. When selecting the OFF condition, the second voltage applied after the end of the write period is +12 [V], while the voltage applied last is 0 [V] and its polarity is not reversed. Therefore, the decrease in light transmittance in this 0-volt period is slightly less than in the eighth embodiment. For this reason, the light transmittance in the OFF condition was slightly higher than in the eighth embodiment and the contrast ratio fell slightly to 1:15. But this is still higher than the contrast ratio by the prior art method.

Eleventh Embodiment

In this embodiment, the upper limit V2 for the values of |VD1| and |VD2| in the drive method of the eighth embodiment was set at 3 [V] and the values were varied in this range. However, VD1=−VD2 as in the eighth embodiment. By modulating the data voltage in this manner, gray scale display was made possible.

Twelfth Embodiment

Figure 14A:
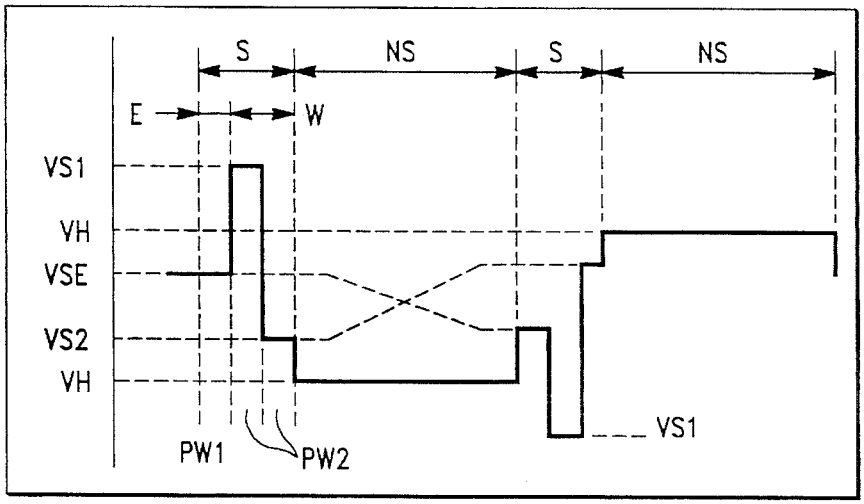
FIGS. 14A and 14B show drive voltage waveforms of a twelfth embodiment of the invention.
Figure 14B:
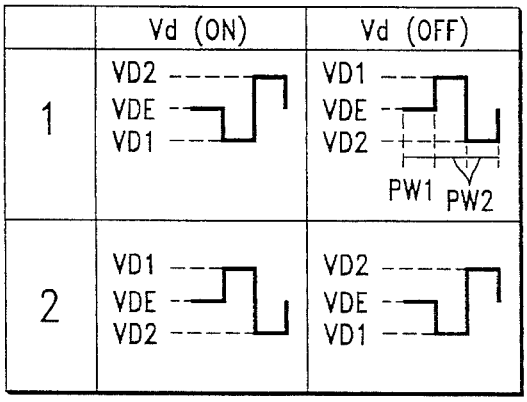

Using the same sample as in the eighth embodiment, the element was driven by a voltage waveform that was a DC maintenance voltage waveform as shown in FIGS. 14A and 14B. VS1=15 [V], VS2=−4 [V], V11=−8 [V], |VD1|=|VD2|=3 [V], VSE=0 [V] and VDE=3 [V]. Since the average value of the applied voltage within one frame period is not zero, the average value within a unit time period was made zero by inverting the polarities of all the voltage waveforms every frame. In this drive method, the polarity (negative) of VSE—VDE is opposite the polarity of VH (positive) immediately before it. Therefore, PW1 was set to 150 μs.

As in the eighth embodiment, a contrast ratio of 1:17 was obtained in the display characteristic. Also, as in the eleventh embodiment, gray scale display could be performed by modulating the data voltage.

In this embodiment, VSE=0 [V], but it need not necessarily equal 0 [V]. Also, the designation VSE−VDE need not necessarily be negative. Further, |VS2| need not necessarily be greater than |VD2|.

Thirteenth Embodiment

Figure 15A:
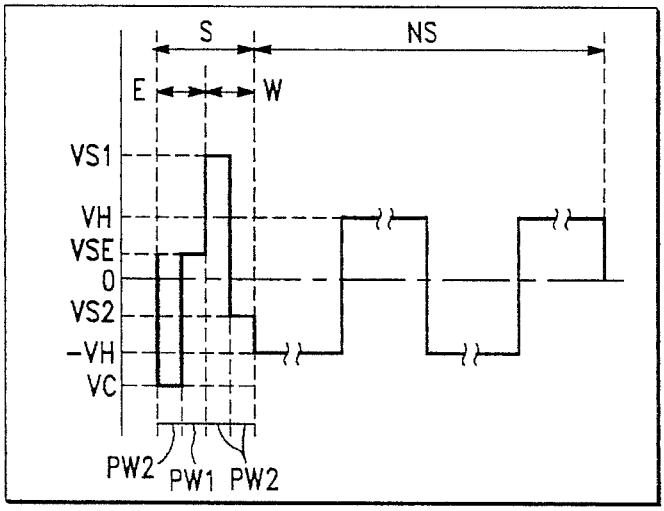
FIGS. 15A and 15B show drive voltage waveforms of a thirteenth embodiment of the invention.
Figure 15B:
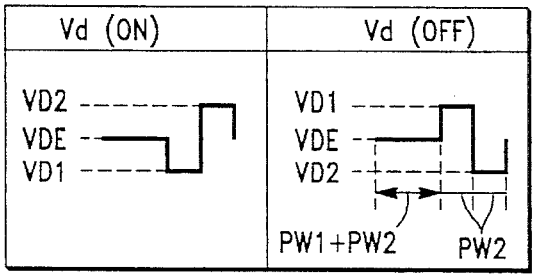

Referring to FIGS. 15A and 15B, a compensation voltage pulse is applied in the blanking period. Assuming the peaks of the voltage pulses applied to the scanning electrodes and the signal electrodes at the end of the blanking period are VSE and VDE, respectively, the settings for each of the voltages are the same as in the first to the third embodiments. Of course, the scanning time by this method is longer than in the eighth embodiment by only PW2. However, the same display characteristic as in the eighth to the tenth embodiments was obtained.

Fourteenth Embodiment

Figure 16A:
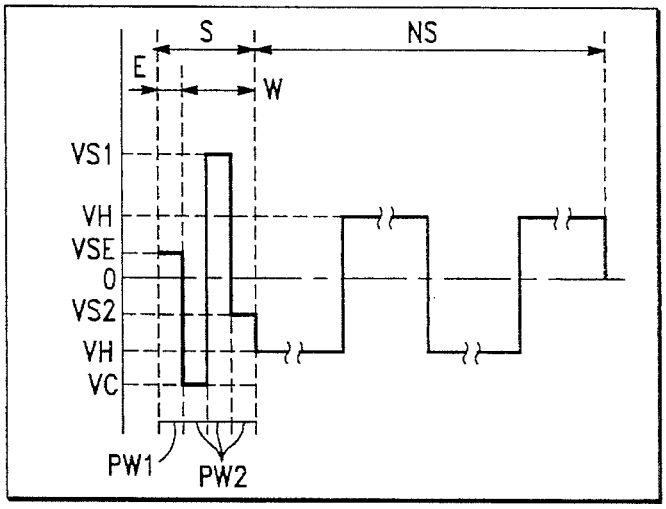
FIGS. 16A and 16B show drive voltage waveforms of a fourteenth embodiment of the invention.
Figure 16B:
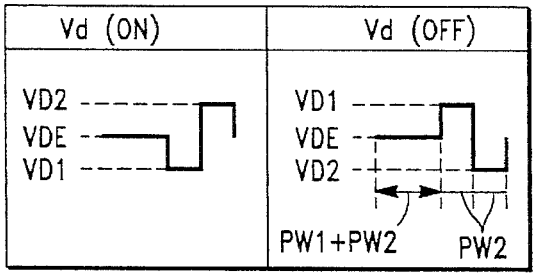

Referring to FIGS. 16A and 16B, compensation voltage pulse Vc is applied at the beginning of the write period. The settings for each of the voltages are the same as in the tenth embodiment. Since |VS2|=|VD2|, the peak value (|VS1|−|VS2|) of the compensation voltage becomes equal to the threshold value. Therefore, since the compensation voltage can maintain the condition (antiferroelectric phase) obtained in the blanking period, it has no effect on the display characteristic and the same display characteristic as in the tenth embodiment is obtained.

Fifteenth Embodiment

Figure 17A:
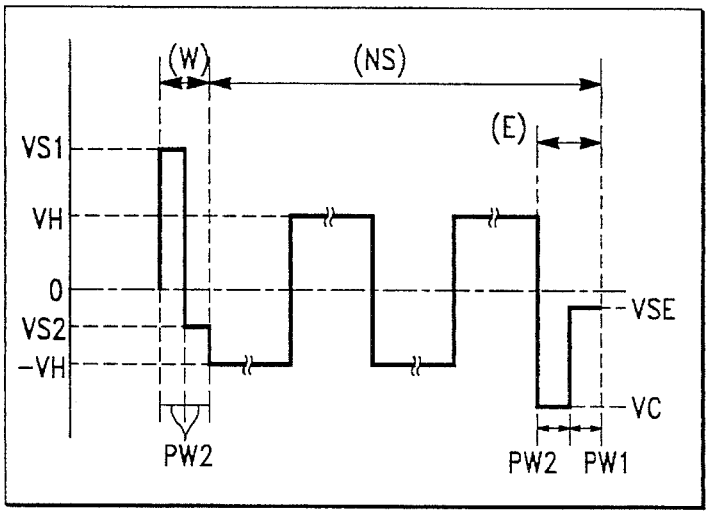
FIGS. 17A and 17B show drive voltage waveforms of a fifteenth embodiment of the invention.
Figure 17B:
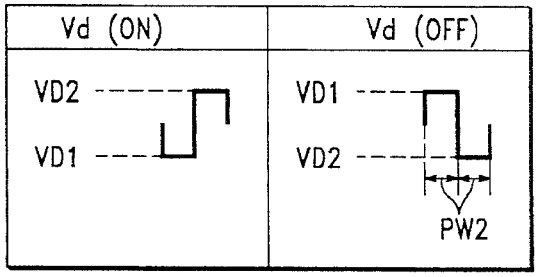
Figure 18:
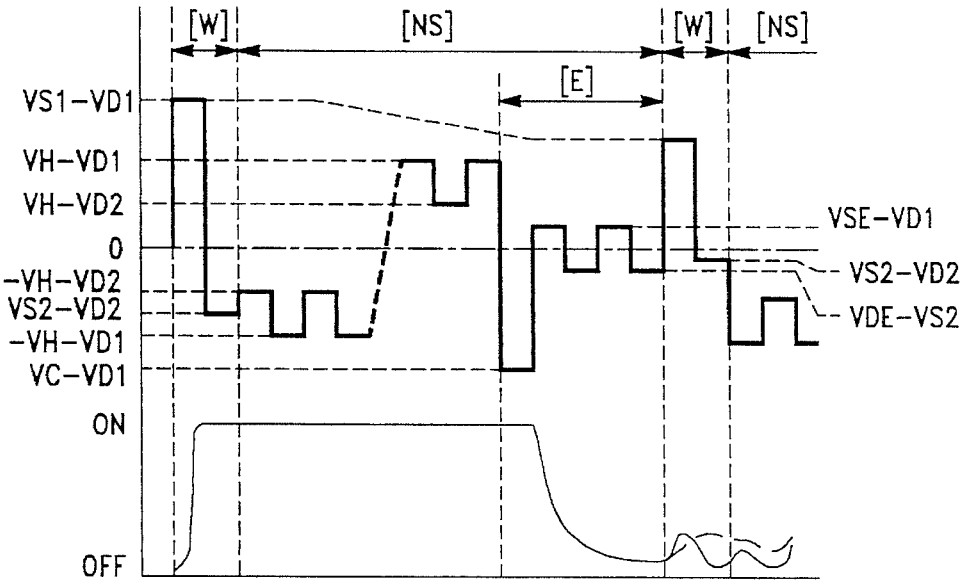
FIG. 18 shows the voltage waveform applied to the liquid crystal layer and the electro-optical response of the liquid crystal in the fifteenth embodiment of the invention.

FIG. 17A is the scanning voltage waveform and Vd(OFF) and Vd(ON) in FIG. 17B are the data voltage waveforms for selecting an antiferroelectric phase (OFF condition) and ferroelectric phase (ON condition), respectively. The top part of FIG. 18 is the voltage waveform applied to the liquid crystal layer and is a composite waveform of the scanning voltage waveform and the data voltage waveform. The lower part of FIG. 18 is the electro-optical response of the liquid crystal to the voltage waveform. The reset voltage is VSE=0 [V] and the data voltage is |VD1| =|VD2|=3[V], and the peak value of the second write voltage pulse after the end of the selection period is VS1=17[V] and the peak value of the last write voltage pulse is VS2=−4 [V]. A ±9-[V] AC voltage pulse that begins with negative polarity is used as the maintenance voltage waveform. Also, a voltage pulse of pulse width PW2 and peak value VC=−(VS1+VS2+ VSE)=−13 [V] is applied as the compensation voltage waveform at the beginning of the reset period. The drive duty ratio and pulse width PW1 and PW2 are 1/1000 and 480 μs and 80 μs, respectively, and the frequency of the maintenance voltage waveform is $1/(1.991\times10^{-3})$ Hz.

When the ON data voltage waveform Vd(ON) is applied to the signal electrodes, the second voltage applied to the liquid crystal layer after the end of the selection period becomes VS1−VD1=20 [V], and therefore there is a transition from an antiferroelectric phase to ferroelectric phase (+). The following last voltage is −7 [V]. When the peak value of the pulse voltage changes directly from +20 [V] to −7 [V] in this manner, the condition passes through an antiferroelectric phase and switches to the other ferroelectric phase (−) because 7 [J] is greater than [V(F−A)tl. Following this, the maintenance voltage pulses from −6 to −12[V[ and from 6 to 12[V] are alternately applied in the non-selection period, which causes alternating ferroelectric phase (−) and ferroelectric phase (+) conditions and maintains the ON condition.

Next, when OFF data voltage waveform Vd(OFF) is applied to the signal electrodes, the second voltage applied to the liquid crystal layer after the end of the selection period becomes 14 [V]. Since this value is less than |V(A−F)tl, there is no transition from an antiferroelectric phase to a ferroelectric phase (+). The light transmittance at this time is $I_{NS}$ as shown in FIG. 13. The following last voltage is −1 [V]. Since the polarity of this voltage is opposite that of the second voltage from the end, the light transmittance drops to nearly zero during this period. Following this, the maintenance voltage pulses from −6 to −12[V[ and from 6 to 12[V] are alternately applied in the non-selection period. In this case, the light transmittance changes so that it nearly follows loop B shown in FIG. 13. However, only the positive polarity side is shown in this figure.

The change with time in the actual light transmittance by this driving method is indicated by the solid line in FIG. 18. For the sake of comparison, the light transmittance in the case of drive by a prior art method is indicated in the same figure by a dashed line. By this means, though no difference in light transmittance is observed between the two in the ON condition, there is a clear difference in light transmittance in the OFF condition. The average light transmittance in the OFF condition in this embodiment is about two thirds of that by the prior art method. Since the contrast ratio is inversely proportional to the light transmittance in the OFF condition, the contrast ratio is nearly 1.5 times that in the prior art being improved from 1:17 to 1:24. Further, since one compensation voltage pulse is applied as described above, the time average value of the voltage applied to the liquid crystal layer in one frame becomes zero and there is no polarization of the electric charge in the liquid crystal substance.

Sixteenth Embodiment

In this embodiment, VS2=−3 [V] in the drive method of the fifteenth embodiment. In this case, VC=−14 [V]. Other settings are the same as in the first embodiment. When selecting the OFF condition, the second voltage applied from the end of the write period is +14 [V], while the voltage applied last is 0 [V] and does not have reversed polarity. For this reason, the amount of decrease in light transmittance in this 0-volt period is slightly less than in the fifteenth embodiment. Therefore, the light transmittance in the OFF condition is slightly greater than in the fifteenth embodiment and the contrast ratio is slightly lower at 1:22. However, this contrast ratio is higher than in the prior art.

Seventeenth Embodiment

In this embodiment, the upper limit V2 for the values of ]VD1| and |VD2| in the drive method of the fifteenth embodiment was set at 3 [V] and the values were varied in this range. However, VD1=−VD2 as in the fifteenth embodiment. By modulating the data voltage in this manner, gray scale display was made possible.

Eighteenth Embodiment

Figure 19A:
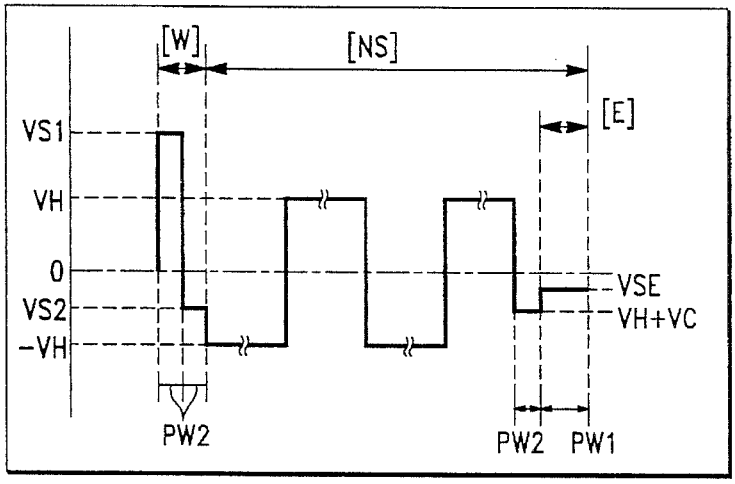
FIGS. 19A and 19B show drive voltage waveforms of a eighteenth embodiment of the invention.
Figure 19B:
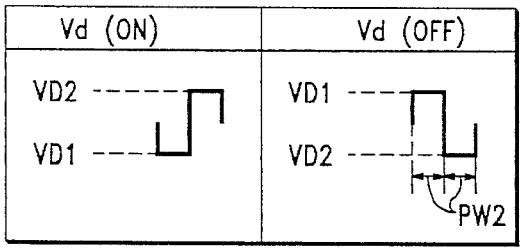

In this embodiment, a compensation voltage waveform was superposed on the maintenance voltage waveform applied in the non-selection period as shown in FIG. 19. VS1=17 [V], VS2=−4 [V], VH=±9 [V], VC=−13 [V] and [VD1[=|VD2|=3[V]. Therefore, the voltage (VH+ VC) of that part of the compensation voltage waveform superposed on the maintenance voltage waveform becomes −4 [V]. In this embodiment, as well, a display characteristic similar to that of the fifteenth embodiment was obtained.

Nineteenth Embodiment

Figure 20A:
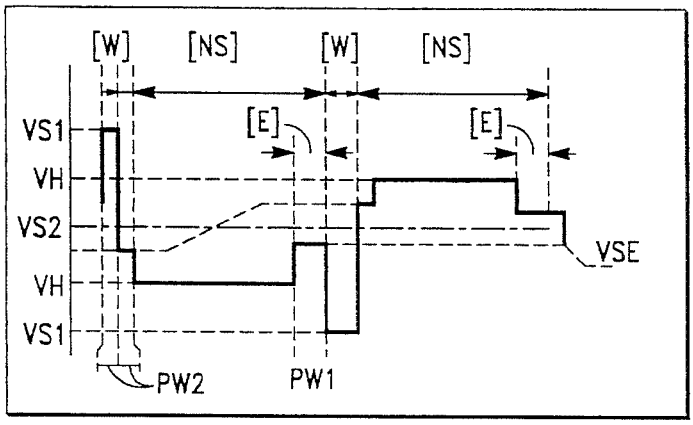
FIGS. 20A and 20B show drive voltage waveforms of a nineteenth embodiment of the invention.
Figure 20B:
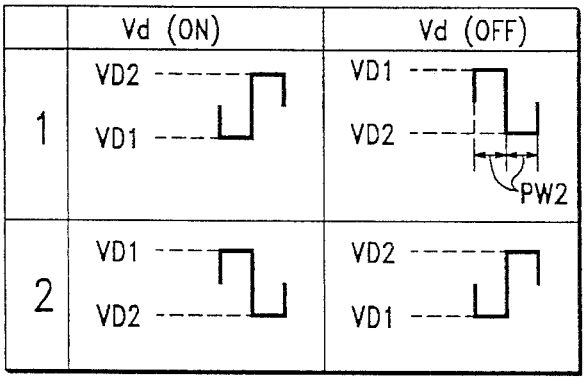

As shown in FIGS. 20A and 20B, the element was driven by a voltage waveform that was a DC maintenance voltage waveform. VS1=17 [V], VS2=−4 [V], VH=−9 [V], |VD1|=|VD2|=3 [V] and VSE=0 [V]. Since the average value of the applied voltage within one frame period is not zero, the average value within a unit time period was made zero by inverting the polarities of all the voltage waveforms every frame. A display characteristic with the same contrast ratio, 1:24, as in the fifteenth embodiment was obtained. Also, gray scale display could be performed as in the eighteenth embodiment by modulating the data voltage.

Twentieth Embodiment

Figure 21A:
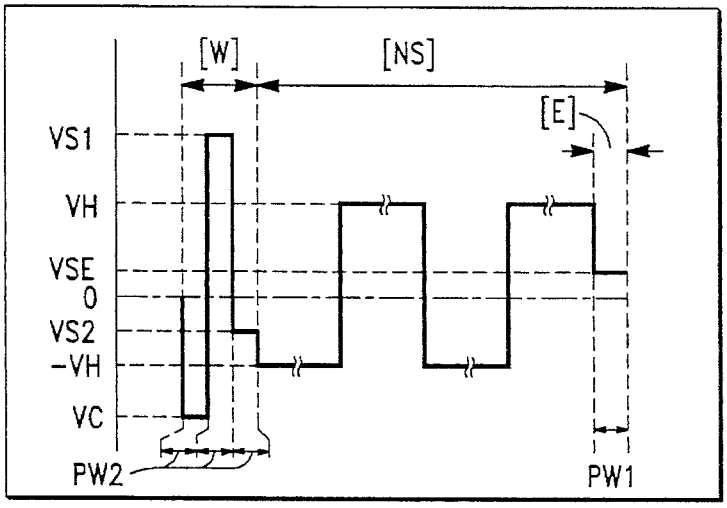
FIGS. 21A and 21B show drive voltage waveforms of a twentieth embodiment of the invention.
Figure 21B:
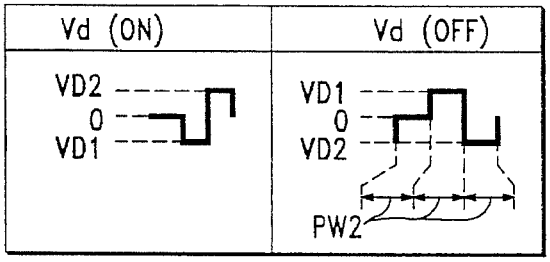

The drive voltage waveforms used in this embodiment are shown in FIGS. 21A and 21B. the settings for each of the voltages are the same as in the second embodiment. Since |VS2|=|VD2|, the peak value (|VS1|−|VS2|) of the compensation voltage becomes equal to the threshold value. Therefore, as in the fourteenth embodiment, this compensation voltage has no effect on the display characteristic and the same display characteristic as in the sixteenth embodiment was obtained. However, the scanning time by this method is longer than in the sixteenth embodiment by only PW2.

Twenty-First Embodiment

Using the same configuration as in the fifteenth embodiment, we set the environmental temperature to 100° C. Due to the higher temperature than in the fifteenth embodiment, the relaxation time from a ferroelectric phase to an antiferroelectric phase was shorter. Therefore, drive was possible even when PW1=160 μs, and a contrast ratio of 1:22 was obtained.

Twenty-Second Embodiment

Figure 22:
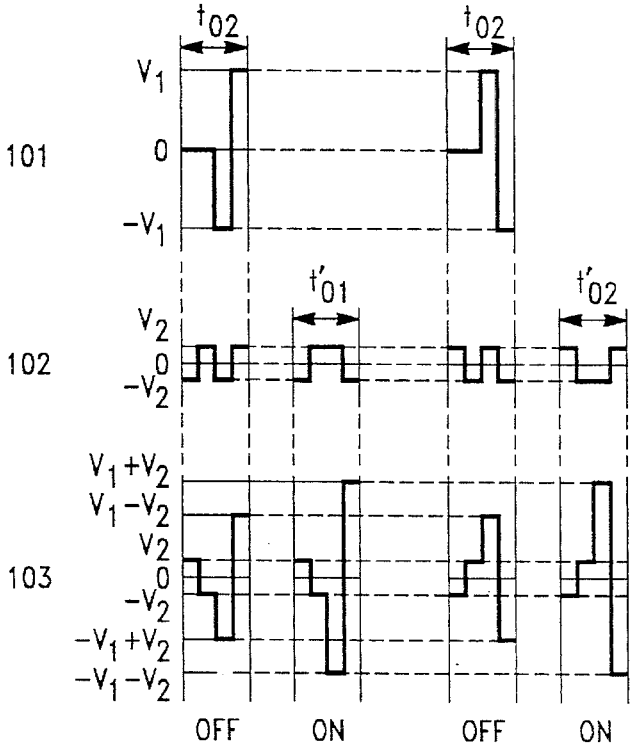
FIG. 22 shows drive voltage waveforms in a selection period of the twenty-second embodiment of the invention.
Figure 23:
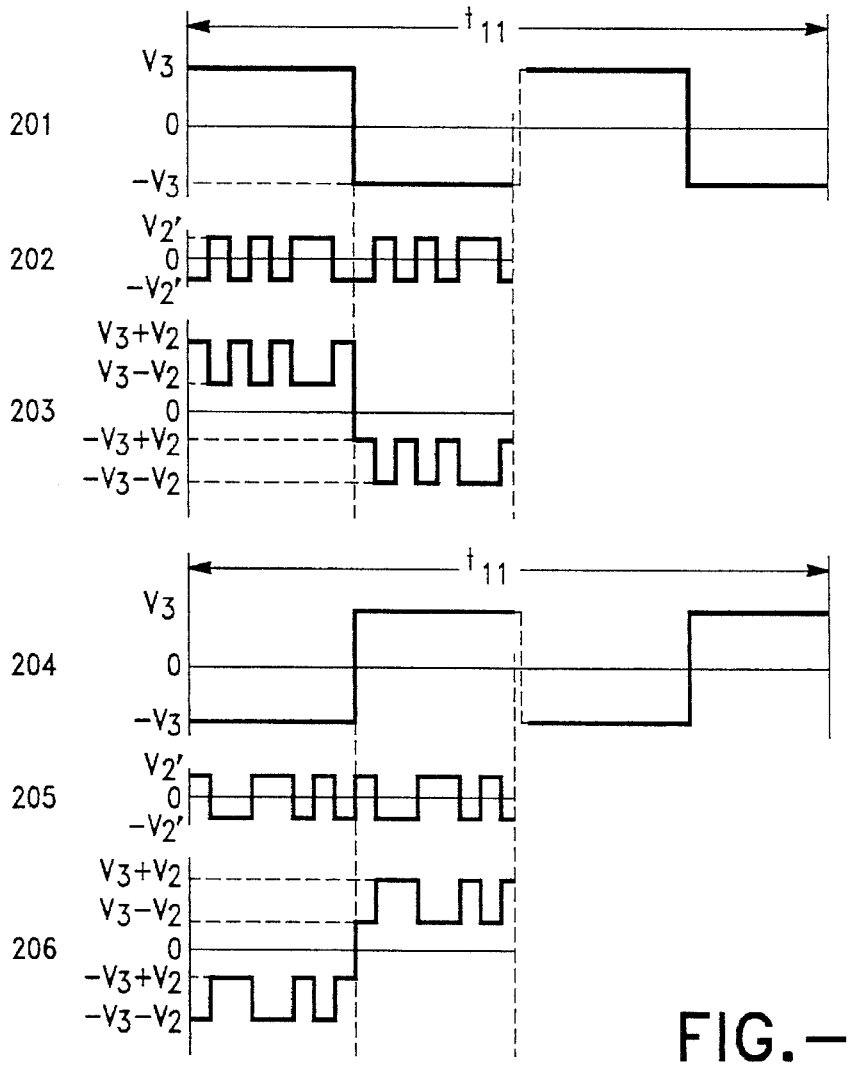
FIG. 23 shows drive voltage waveforms in a non-selection period of the twenty-second embodiment of the invention.
Figure 24:
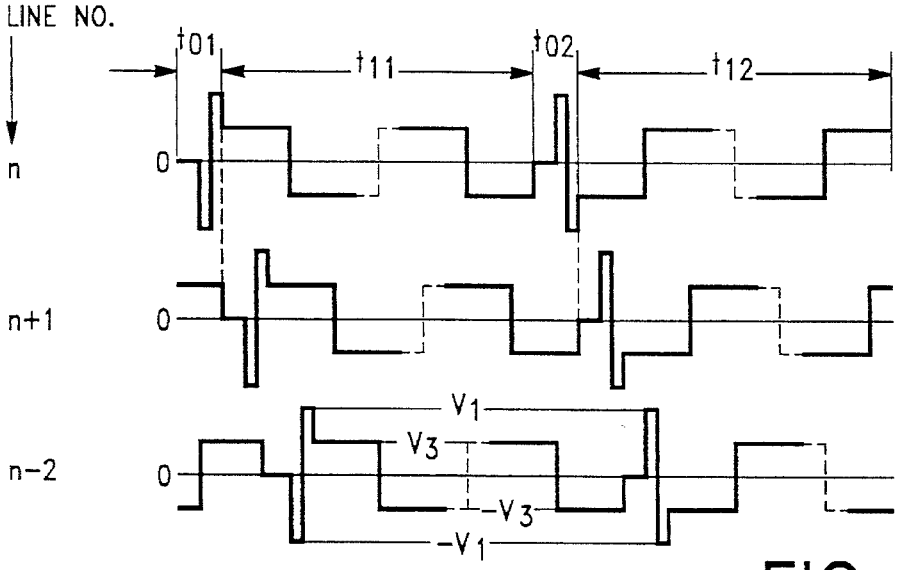
FIG. 24 shows the timing of voltage waveforms applied to adjacent selected scanning electrodes in the drive waveforms of the twenty-second embodiment of the invention.

The drive voltage waveforms in this embodiment of the invention are shown in FIGS. 22–24.

FIG. 24 shows the timing of the drive voltage waveforms applied to the scanning electrodes. In the figure, $t_{01}$ and $t_{02}$ are the selection periods for selected scanning electrodes n, and $t_{11}$ and $t_{12}$ are non-selection periods. A configuration is used in which the selection pulse $\pm V_1$ is applied in the selection period, the AC bias $\pm V_3$ is applied in the non-selection period and the polarities are inverted every frame. Similar voltage waveforms having a phase difference of one selection period are line-sequentially applied to adjacent scanning electrodes.

FIG. 22 shows the voltage waveform applied in the selection period and 101 is the scanning electrode waveform, 102 is the signal electrode waveform and 103 is a composite waveform of 101 and 102. The polarities of the applied waveforms invert in $t_{01}$ and $t'_{01}$ and in $t_{02}$ and $t'_{02}$, and $t_{01}$ and $t_{02}$, and $t'_{01}$ and $t'_{02}$ are OFF selection waveforms and ON selection waveforms, respectively. The voltage settings are $|V_1+V_2| \geqq |V(A-F)_S|$ and $|V_1-V_2| \leqq |V(A-F)_t|$.

FIG. 23 shows the voltage waveform applied in the non-selection period. In the figure, 201,204 are scanning electrode waveforms, 202,205 are signal electrode waveforms and 203, 206 are composite waveforms, and in the case of 201, 202 and 203, and 204, 205 and 206, the polarities are inverted. The setting conditions for the voltages are:

$$|V(F-A)_t| > |V_3 \mp V_2| \leqq |V(A-F)_t|$$

By means of drive method of the above configuration, the voltage waveform applied to the liquid crystal layer in one frame is made an alternating current, and therefore there is no danger of element degradation due to DC component. Since the bias applied in the non-selection period inverts its polarity multiple times in one frame, polarization of the electric charge due to the spontaneous polarization of the liquid crystal molecules does not readily occur, and by optimizing the inversion period, flickering of the display can also be reduced. Further, as shown in FIG. 22, the pulse applied at the beginning of the selection period and whose absolute value is less than the threshold of the element is set so that its polarity becomes opposite that of the pulse applied at the end of the non-selection period of the previous frame (see FIG. 23).

When the element was maintained at a temperature of 90° C. and was driven under the conditions pulse width=80 μs, $V_1$=18 V, $V_2$=2.7 V and $V_3$=5 V, a contrast ratio of 1:23 was obtained. By inverting the polarity of the bias applied in the non-selection period every 10 to 15 ms, flickering of the display image could be reduced to a non-observable level.

Twenty-Third Embodiment

Figure 25:
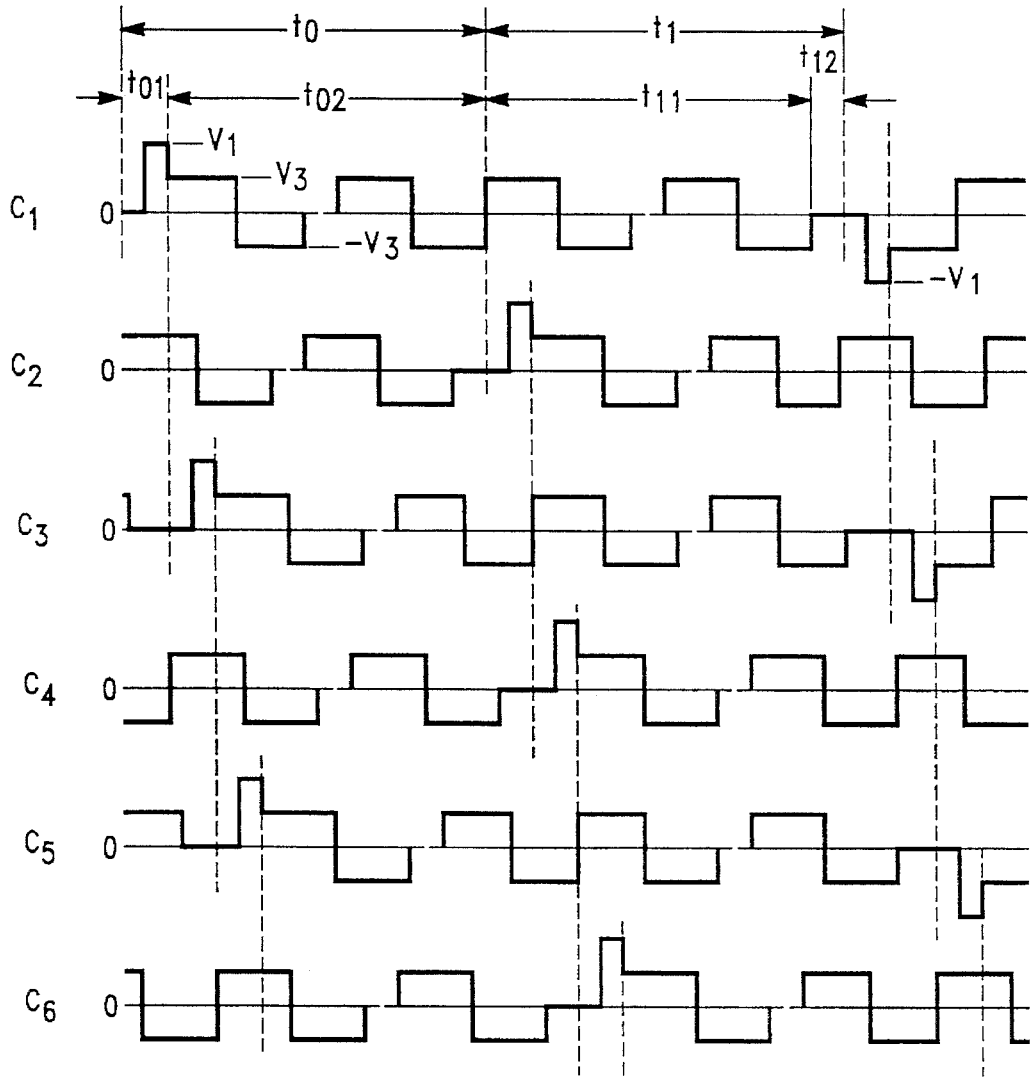
FIG. 25 shows the timing of voltage waveforms applied to adjacent selected scanning electrodes in the drive waveforms of the twenty-third embodiment of the invention.
Figure 27:
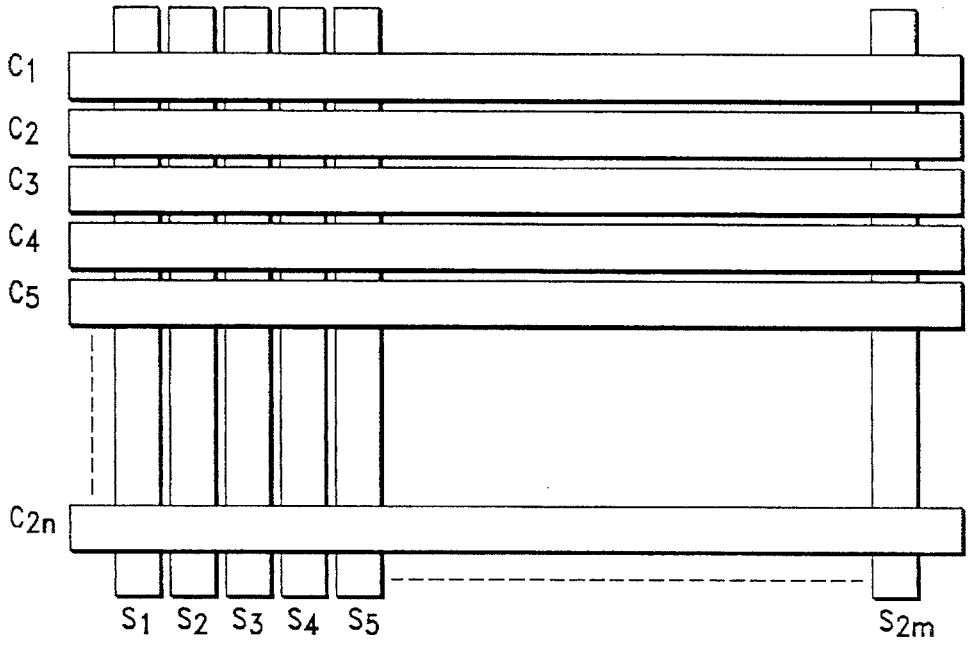
FIG. 27 shows the pixels disposed in the matrix of an element to which the invention is applied.

The voltage waveforms applied to scanning electrodes $C_1$–$C_6$ and their timing when every other scanning electrode, i.e., $C_1, C_3, C_5, \ldots, C_{2n-1}, C_2, C_4, C_6, \ldots, C_{2n}$, are sequentially selected and scanned in the time-sharing addressing of a display element such as that shown in FIG. 27 comprising 2n (n is a positive integer) scanning electrodes ($C_1, C_2, \ldots, C_{2n}$) are shown in FIG. 25. In the figure, $t_{01}$ is the selection period of scanning electrode $C_1$, and $t_{02}$, $t_{11}$ and $t_{12}$ are non-selection periods. The selection period of $C_3$ is set immediately after $t_{01}$ and the selection period of $C_5$ is set immediately after that, and the selection and scanning of the odd-numbered rows is completed in period $t_0$. Then in period $t_1$, the even-numbered rows are similarly selected and scanned, whereby one screen of information is written in period $t_0+t_1$. During the period the odd-numbered rows are selected and scanned ($t_0$ in figure), a bias voltage for maintaining the previously selected display condition is applied on the even-numbered rows, and during the period the even-numbered rows are selected and scanned ($t_1$ in figure), a bias voltage for maintaining the previously selected display condition is applied on the odd-numbered rows. Also, the polarities of the voltage waveforms applied to the respective scanning electrodes are inverted every $t_0+t_1$ time period, resulting in the voltages applied to the liquid crystal layer being made alternating currents.

Figure 26:
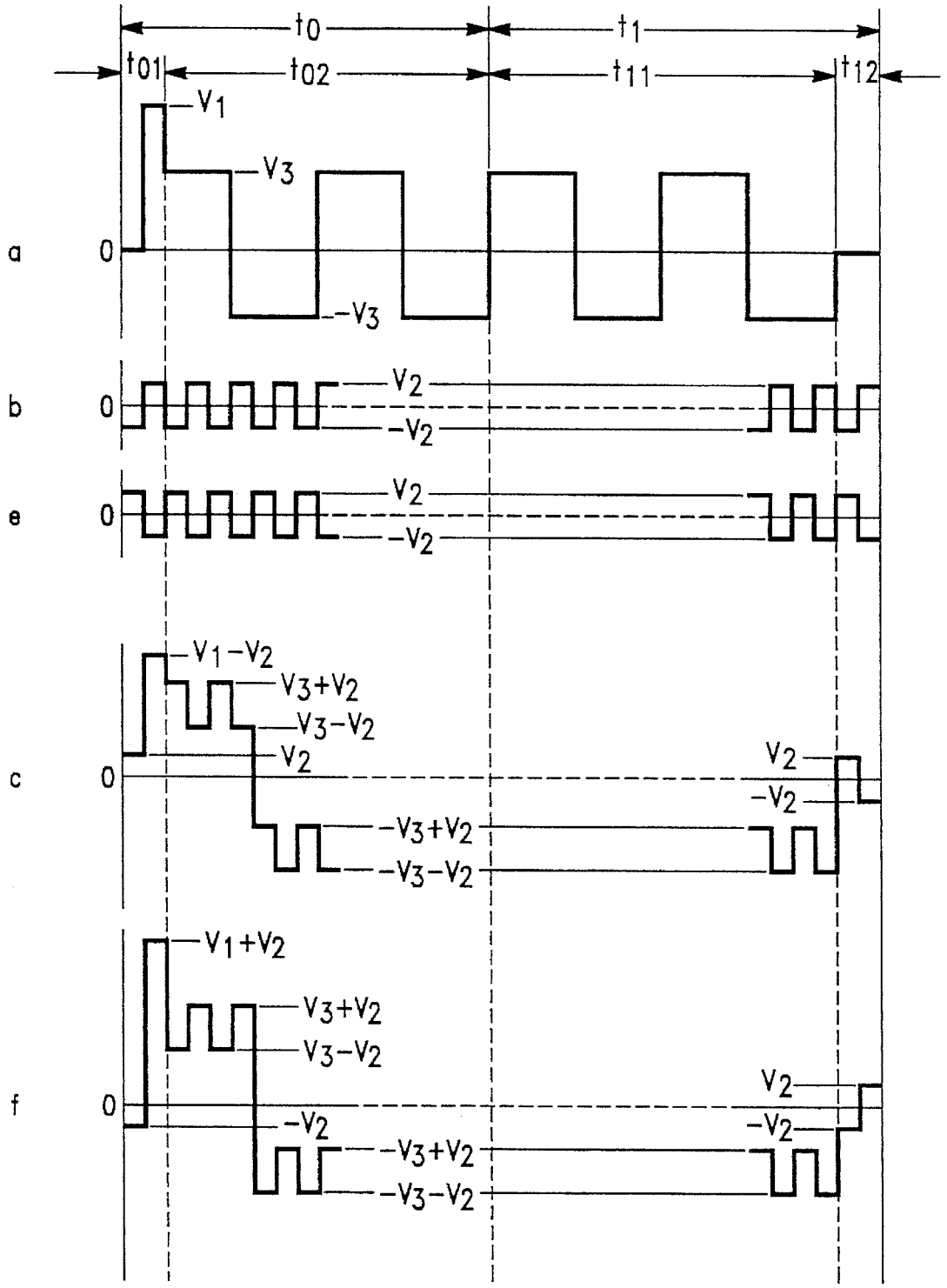
FIG. 26 shows drive voltage waveforms of a twenty-third embodiment of the invention.

FIG. 26 shows the drive voltage waveforms for switching pixels. In the figure, a is a scanning electrode waveform, b and e are signal electrode waveforms, and c and f are composite waveforms of a and b, and a and e, respectively. Also, c is the voltage waveform when the OFF condition (orientation state of antiferroelectric phase) is selected, and during selection period $t_{01}$, a pulse with peak value $V_1-V_2$ ($|V_1-V_2|<|V(A-F)t|$) is applied and the pixels go to an OFF condition, while during non-selection periods $t_{02}$, $t_{11}$ a pulse group with peak value $V_3\pm V_2$($|V_3\pm V_2|<|V(A-F)t|$) applied and maintains the OFF condition while inverting its polarity within a fixed period. Waveform f, however, is a voltage waveform for selecting the ON condition (orientation state of ferroelectric phase), and in the selection period $t_{01}$, a pulse with peak value $V_1+V_2$ ($|V_1+V_2|>|V(A-F)s|$) is applied and the pixels go to an ON condition. During non-selection periods $t_{02}$ and $t_{11}$, a pulse group with peak value $V_3\pm V_2$ ($|V(F-A)t|<|V_3\pm V_2|<|V(A-F)t|$) is applied while inverting its polarity within a fixed period, whereby it maintains the ON condition while switching the liquid crystal molecules between their two ferroelectric phase states. In the last period $t_{12}$ of the non-selection period, a voltage pulse with peak $\pm V_2$($|\pm V_2|<|V(F-A)s|$]) is applied and the pixels return to the antiferroelectric phase orientation.

When the element was maintained at a temperature of 90° C. and was switched ON and OFF by a drive waveform under the conditions pulse width=80 μs, $V_1$=18 V, $V_2$=2.7 V and $V_3$=5 V, a contrast ratio of 1:22 was obtained. When one screen was formed by two horizontal scans of a 1000-line display element, the time required for one scan was 80 μs.

When the same element was driven using similar voltage settings, the temperature of the element was varied from 70° to 100° C., and the blanking period ($t_{12}$ in figure) in the non-selection period was set to 250 μs at 70° C. and 170 us at 100° C. and continuously varied over that interval, an optical characteristic similar to that obtained above could be maintained within the temperature range.

Twenty-Fourth Embodiment

Using the same sample and voltage and pulse width settings as in the twenty-third embodiment, the environmental temperature was set at 104° C. in this embodiment. The relaxation time for ferroelectric phase antiferroelectric phase transition was 150 μs. Here, the length of blanking period $t_{12}$ was 0. Since the length of the selection period was 160 μs in this case, both the ferroelectric phase and antiferroelectric phase conditions could be achieved in the selection period without providing a blanking period.

When the element was driven by 1/1000-duty multiplexing drive under these conditions, a contrast ratio of 1:25 was obtained.

Also, though one screen of information was written by two screen scans that skipped every other scanning electrode in this embodiment, the number of skips can be set as desired.

Twenty-Fifth Embodiment

Figure 28:
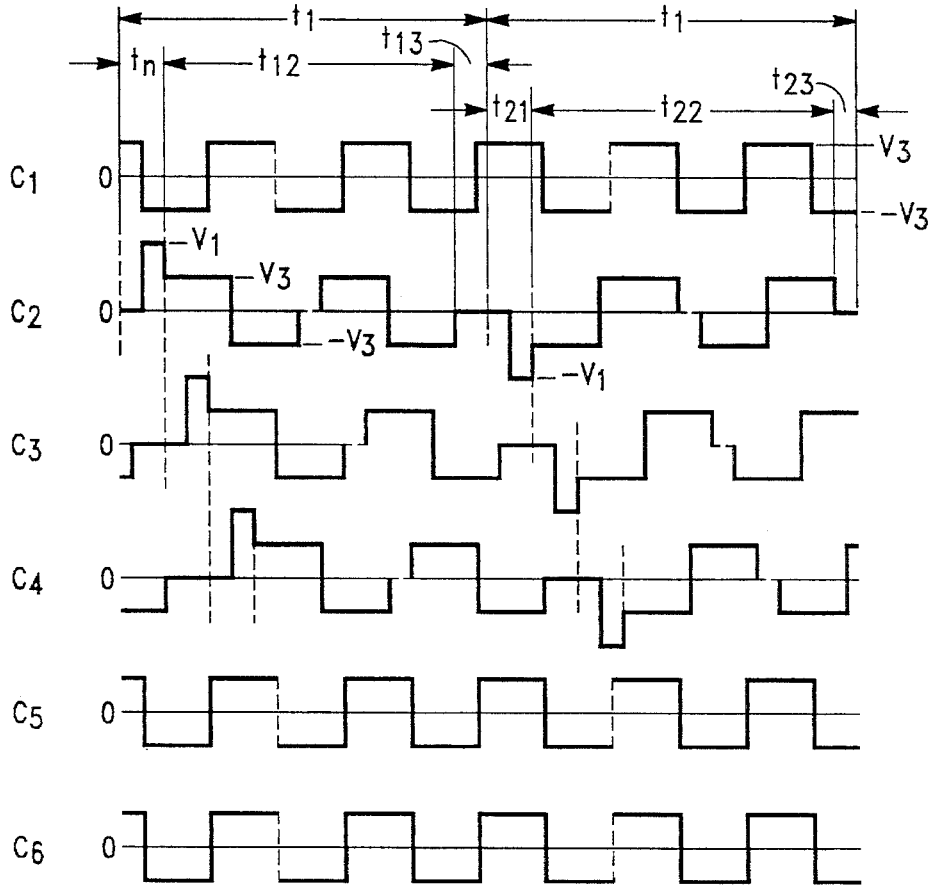
FIG. 28 shows the timing of voltage waveforms applied to adjacent selected scanning electrodes in the drive waveforms of the twenty-third embodiment of the invention.

The voltage waveforms applied on scanning electrodes $C_1$–$C_6$ and their timing when it becomes necessary to write information in the scanning electrode area $C_2$, $C_3$ and $C_4$ and the information already written in other areas is to be maintained in the time-shared drive of a display element such as that shown in FIG. 27 comprising 2n (n is a positive integer) scanning electrodes ($C_1, C_2, \ldots, C_{2n}$) are shown in FIG. 28. In the figure, $t_{11}$, $t_{21}$ are the selection periods of scanning electrode $C_2$, and $t_{12}$, $t_{13}$ and $t_{22}$, $t_{23}$ are non-selection periods. The selection period of $C_3$ is set immediately after $t_{01}$ and the selection period of $C_4$ is set immediately after that, and the selection waveform is applied on the three electrodes by these. Also, the polarities of the voltage waveforms applied to the respective scanning electrodes are inverted every $t_1$, $t_2$ time period, resulting in the voltages applied to the liquid crystal layer being made alternating currents. A bias voltage for maintaining the previously selected display condition is applied to the other electrodes while its polarity is inverted every fixed period.

Figure 29:
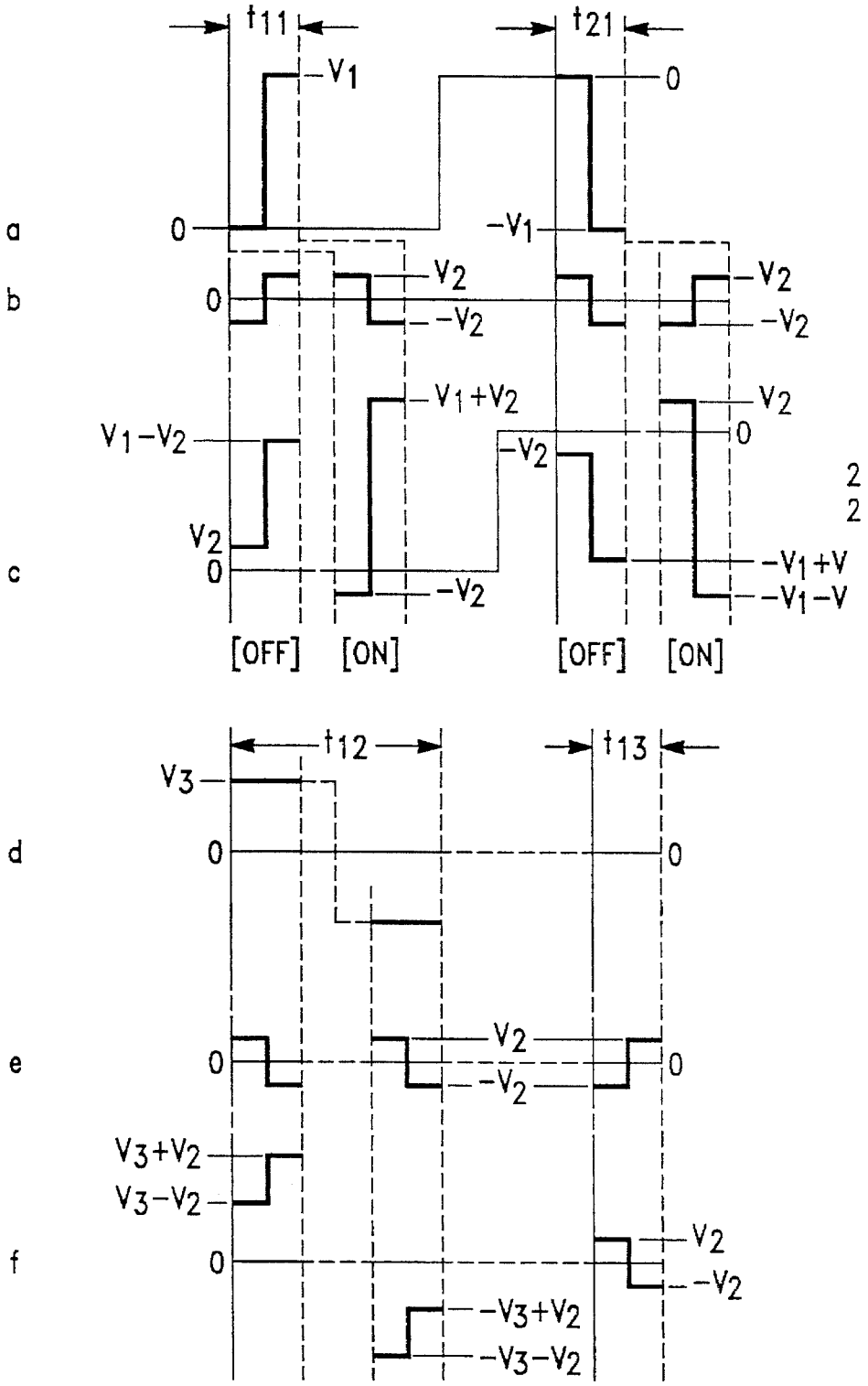
FIG. 29 shows drive voltage waveforms of a twenty-fifth embodiment of the invention.

FIG. 29 shows the drive voltage waveforms for switching pixels. In the figure, a is a scanning electrode waveform in the selection period, b and e are signal electrode waveforms, d is a scanning electrode waveform in the non-selection period, and c and f are composite waveforms of a and b, and d and e, respectively. Also, [OFF] of c is the voltage waveform when the OFF condition (orientation of antiferroelectric phase) is selected, and during selection periods $t_{11}$ and $t_{21}$, a pulse with a voltage absolute value of $|V_1-V_2|$ ($|V_1-V_2|<|V(A-F)t|$) is applied and the pixels go to an OFF condition. [ON] of c is the voltage waveform when the ON condition (orientation of ferroelectric phase) is selected, and during selection periods $t_{11}$ and $t_{21}$, a pulse with a voltage absolute value of $|V_1+V_2|$($|V_1+V_2|>|V(A-F)s|$) is applied and the pixels go to an ON condition. During non-selection period $t_{12}$, a pulse group with a voltage absolute value of $|V_3\pm V_2|$($|V(F-A)t|<|V3\pm V2|<|V(A-F)t|$) is applied and maintains the condition selected in the previous selection period while inverting its polarity within a fixed period as shown in FIG. 29*f*. In the last period $t_{13}$ of the non-selection period, a voltage pulse with peak $\pm V_2(|\pm V_2|<|V(F-A)s|)$ is applied and the pixels return to an antiferroelectric phase orientation.

When the element was maintained at a temperature of 90° C. and was switched ON and OFF by a drive waveform under the conditions pulse width=80 μs, $V_1$=18 V, $V_2$=2.7 V and $V_3$=5 V, a contrast ratio of 1:23 was obtained. The time required to rewrite 100 lines of display in a 1000-line display element was 16 ms.

When the same element was driven using similar voltage settings, the temperature of the element was varied from 70° to 100° C., and the blanking period ($t_{13}$ in figure) in the non-selection period was set to 250 μs at 70° C. and 170 μs at 100° C. and continuously varied over that interval, an optical characteristic similar to that obtained above could be maintained within the temperature range.

Twenty-Sixth Embodiment

Using the same sample and voltage and pulse duration settings as in the twenty-fifth embodiment, the environmental temperature was set at 104° C. in this embodiment. The relaxation time for ferroelectric phase antiferroelectric phase transition was 150 μs. Here, the length of blanking period $t_{12}$ was 0. Since the length of the selection period was 160 μs in this case, both the ferroelectric phase and antiferroelectric phase could be achieved in the selection period without providing a blanking period.

When the element was driven by 1/1000-duty multiplexing drive under these conditions, a contrast ratio of 1:24 was obtained.

First Comparison Example

As a comparison to the sixth embodiment, we performed drive using the prior art example shown in FIG. 30. Using the same sample and temperature settings as in the sixth embodiment, we drove the element by 1/400-duty multiplexing drive under the conditions pulse width Pw=80 μs, te=6×Pw, selection period ts=7×Pw, $V_1$=18 V, $V_2$=5 V and $V_3$=2.7 V and obtained a contrast ratio of 1:22. Also, the time required to display one screen of information was ts×400×2=448 ms. However, no degradation of display quality was observed in the reliability test of this comparison example.

Second Comparison Example

As a comparison example, we selected ferroelectric phase (+) (ON condition) in frames F(+) and F'(+) and antiferroelectric phase (OFF condition) in frames F(−) and F'(−) without using the two-frame selection method in the drive method shown in FIG. 30. The time required to display one screen of information was ts×400=224 ms.

When the ON and OFF conditions were alternately repeated in this manner, a downward polarization field was generated because ferroelectric phase (+) was continually selected, and the time average value of the voltage actually impressed on the liquid crystal layer was not zero but a negative value. Therefore, negative and positive ions tended to accumulate at the upper and lower interfaces between the liquid crystal layer and the substrates, respectively, and so the threshold value during transition from an antiferroelectric phase to ferroelectric phase (−) was higher than the threshold value during transition from an antiferroelectric phase to ferroelectric phase (+), which indicated there would be a degradation of display quality. To test this, we performed a reliability test of this comparison example in which the ON condition (ferroelectric phase (+)) and OFF condition were repeated over four weeks and the change in display quality before and after was investigated. When investigating the display quality, we selected an antiferroelectric phase in frame F(+) and ferroelectric phase (−) (ON condition) in frame F(−) to clarify the effect of the polarization electric field on the antiferroelectric phase-ferroelectric phase (−) (transition. If the polarization electric field had no effect, there should be no change in the display quality of the ON condition from before the test. However, the results of the reliability test showed a change in the threshold characteristic, with the light transmittance in the ON condition after the test dropping to about 50% of that before the test.

Applicability to Industry

The drive method for a liquid crystal optical device of the invention can be applied to superfine liquid crystal display devices and light valves, spatial light modulators, etc.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the subjoined claims.

APPENDIX I

| | |
|---|---|
| 1a, 2a, Vt, 101, 201, 204, a, d | scanning electrode waveforms |
| 1b, 2b, Vd, 102, 202, 205, b, e | signal electrode waveforms |
| 1c, 2c, VLC, 103, 203, 206, c, f | composite waveforms |
| OA | optical axis in antiferroelectric phase |
| OF(+) | direction of molecular orientation (optical axis) in ferroelectric phase (+) |
| OF(−) | direction of molecular orientation (optical axis) in ferroelectric phase (−) |
| 1, 2 | glass substrates |
| 3 | spacer |
| 4, 5 | transparent electrodes |
| 6 | liquid crystal layer |
| 9, 10 | alignment films |
| 11, 12 | polarizers |

What is claimed is:

1. A driving method for a liquid crystal electro-optical element comprising a liquid crystal substance that has two orientation states in a ferroelectric phase and one orientation state in an antiferroelectric phase and is sandwiched between the opposing electrode surfaces of a substrate having scanning electrodes and a substrate having signal electrodes, comprising the step of applying voltage signals to the liquid crystal substance during a selection period and non-selection period, wherein the selection period has (1) a first period in which a voltage pulse for lining up the direction of orientation of the liquid crystal molecules in one orientation state is applied to the liquid crystal substance, and (2) a second period in which a selection voltage pulse is applied to the liquid crystal substance, the selection voltage pulse comprising one of a. a voltage pulse whose absolute value is less than a threshold value if the orientation state to be selected is an antiferroelectric phase, and b. a voltage pulse whose absolute value is larger than the threshold value if the orientation state to be selected is a ferroelectric phase, for selecting whether or not the direction of orientation of the liquid crystal molecules is to be changed from the orientation state in the first period to another orientation state, and wherein the non-selection period has (1) a third period in which a voltage pulse group for maintaining the orientation selected in the second period during the selection period is applied to said liquid crystal substance and (2) a fourth period in which a voltage pulse group whose absolute value is less than the threshold value for one of a. maintaining the state selected in the second period if the selected states is an antiferroelectric phase, and b. relaxing the state selected in the second period to the antiferroelectric phase if the selected state is a ferroelectric phase.

2. The driving method for a liquid crystal electro-optical element of claim 1 wherein each of the voltages applied to said liquid crystal substance is set so that its polarity inverts every fixed period and the sum of the products of each of the applied voltages and time becomes zero.

3. The driving method for a liquid crystal electro-optical element of claim 1 wherein each of the voltages applied to said liquid crystal substance is set so that the sum of the products of the applied voltage and duration becomes zero in one scanning period comprising a selection period and a non-selection period.

4. The driving method for a liquid crystal electro-optical element of claim 1 wherein a first duration of the third period and a second duration of the fourth period in the above non-selection period are each set according to an environmental temperature of the liquid crystal electrooptical element.

5. A driving method for a liquid crystal electro-optical element having a plurality of liquid crystal molecules that have two orientation states in a ferroelectric phase and one orientation state in an antiferroelectric phase, a first substrate having scanning electrodes, a second substrate having signal electrodes, said plurality of liquid crystal molecules sandwiched between opposing electrode surfaces of said first and second substrates, said method comprising the steps of:

a) in a first time period of the selection period, applying to said liquid crystal molecules, a first voltage pulse for lining up the orientation direction of said liquid crystal molecules in one orientation state;

b) in a second time period of the selection period, if the orientation state to be selected is an antiferroelectric phase, applying to said liquid crystal molecules, a second voltage pulse whose absolute value is less than a threshold value;

c) in said second time period of the selection period, if the orientation state to be selected is a ferroelectric phase, applying to said liquid crystal molecules, a voltage pulse whose absolute value is larger than said threshold value;

d) in a third time period of a non-selection period, applying to said liquid crystal molecules, a voltage pulse group for maintaining the orientation state selected in the second time period of said selection period; and e) in a fourth time period of the non-selection period, applying, to said liquid crystal molecules, a voltage pulse group whose absolute value is less than said threshold value independent of the orientation state selected in said second time period.

6. The method of claim 5, further comprising the step of inverting a polarity of each of said voltage pulses applied to said liquid crystal molecules at fixed periodic intervals such that the sum of the products of each of said voltage pulses and time is zero.

7. The method of claim 5, wherein each of said voltage pulses applied to said liquid crystal molecules are such that the sum of the products of said voltage pulses and time equal zero in one scanning period, wherein said scanning period comprises said first, second, third and fourth time periods.

8. The method of claim 5, further comprising the step of changing a first duration of said third period and a second duration of said fourth period in proportion to the temperature of said liquid crystal electro-optical element.

9. The method of claim 5, further comprising the steps of:

applying a selected wave form, line-sequentially, to a first set of said scanning electrodes, wherein said first set of scanning electrodes are operatively coupled to a first plurality of pixels that are changing their display condition; and applying said voltage pulse group for maintaining the orientation state of said liquid crystal molecules on a second set of electrodes, wherein said second set of scanning electrodes are operatively coupled to a second plurality of pixels that are not changing their display condition.

10. A driving apparatus for a liquid crystal electro-optical element having a plurality of liquid crystal molecules that have two orientation states in a ferroelectric phase and one orientation state in an antiferroelectric phase, a first substrate having scanning electrodes, a second substrate having signal electrodes, said plurality of liquid crystal molecules sandwiched between opposing electrode surfaces of said first and second substrates, said driving apparatus comprising driving means for:

a) in a first time period of a selection period, applying to said liquid crystal molecules, a first voltage pulse for lining up the orientation direction of said liquid crystal molecules in one orientation state;

b) in a second time period of the selection period, if the orientation state to be selected is an antiferroelectric phase, applying to said liquid crystal molecules, a second voltage pulse whose absolute value is less than a threshold value;

c) in said second time period of the selection period, if the orientation state to be selected is a ferroelectric phase, applying to said liquid crystal molecules, a voltage pulse whose absolute value is larger than said threshold value;

d) in a third time period of the non-selection period, applying to said liquid crystal molecules, a voltage pulse group for maintaining the orientation state selected in the second time period of said selection period; and e) in a fourth time period of the non-selection period, applying, to said liquid crystal molecules, a voltage pulse group whose absolute value is less than said threshold value independent of the orientation state selected in said second time period.

11. A liquid crystal display apparatus having a liquid crystal electro-optical element having a plurality of liquid crystal molecules that have two orientation states in a ferroelectric phase and one orientation state in an antiferroelectric phase, a first substrate having scanning electrodes, a second substrate having signal electrodes, said plurality of liquid crystal molecules sandwiched between opposing electrode surfaces of said first and second substrates, said liquid crystal display apparatus comprising driving means for:

a) in a first time period of the selection period, applying to said liquid crystal molecules, a first voltage pulse for lining up the orientation direction of said liquid crystal molecules in one orientation state;

b) in a second time period of a selection period, if the orientation state to be selected is an antiferroelectric phase, applying to said liquid crystal molecules, a second voltage pulse whose absolute value is less than a threshold value;

c) in said second time period of the selection period, if the orientation state to be selected is a ferroelectric phase, applying to said liquid crystal molecules, a voltage pulse whose absolute value is larger than said threshold value;

d) in a third time period of the non-selection period, applying to said liquid crystal molecules, a voltage pulse group for maintaining the orientation state selected in the second time period of said selection period; and e) in a fourth time period of the non-selection period, applying, to said liquid crystal molecules, a voltage pulse group whose absolute value is less than said threshold value independent of the orientation state selected in said second time period.

* * * * *